US010011916B2

(12) United States Patent
Barbier et al.

(10) Patent No.: US 10,011,916 B2
(45) Date of Patent: Jul. 3, 2018

(54) SUPERHYDROPHOBIC ANODIZED METALS AND METHOD OF MAKING SAME

(71) Applicants: UT-Battelle, LLC, Oak Ridge, TN (US); University of Pittsburgh, Pittsburgh, PA (US)

(72) Inventors: Charlotte N. Barbier, Knoxville, TN (US); John T. Simpson, Clinton, TN (US); Brian R. D'Urso, Pittsburgh, PA (US); Elliot Jenner, Pittsburgh, PA (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 113 days.

(21) Appl. No.: 14/057,925

(22) Filed: Oct. 18, 2013

(65) Prior Publication Data

US 2014/0110263 A1 Apr. 24, 2014

Related U.S. Application Data

(60) Provisional application No. 61/715,864, filed on Oct. 19, 2012.

(51) Int. Cl.
*C25D 11/12* (2006.01)
*C25D 11/24* (2006.01)
(Continued)

(52) U.S. Cl.
CPC ..... *C25D 11/24* (2013.01); *C25D 11/08* (2013.01); *C25D 11/10* (2013.01); *C25D 11/12* (2013.01);
(Continued)

(58) Field of Classification Search
CPC ..... C25D 11/12
See application file for complete search history.

(56) References Cited

U.S. PATENT DOCUMENTS

2006/0024478 A1* 2/2006 D'Urso et al. ..... 428/156
2006/0251859 A1* 11/2006 D'Urso ..... 428/141
(Continued)

FOREIGN PATENT DOCUMENTS

WO WO 2009110667 A1 * 9/2009 ..... C08F 220/22
WO 2011057422 5/2011
(Continued)

OTHER PUBLICATIONS

Cho, W. K.,; Park, S; Jon, S.; Choi, I. S.; "Water-repellent coating: formation of polymeric self-assembled monolayers on nanostructured surfaces", Nanotechnology, 2007, vol. 18, p. 1-7.*
(Continued)

*Primary Examiner* — Mark Ruthkosky
*Assistant Examiner* — Julia L Rummel
(74) *Attorney, Agent, or Firm* — Fox Rothschild LLP

(57) ABSTRACT

Methods for producing a superhydrophobic anodized surface including anodizing a surface of a substrate in an anodization acid to form a plurality of pores, etching the surface with an etchant to widen an edge of each of the plurality of pores; repeatedly anodizing the surface in the anodization acid and etching the surface with the etchant until the edges of the plurality of pores overlap to form a plurality of nano-sharp ridges, and coating the surface with a hydrophobic polymer to render the surface superhydrophobic, such that the surface exhibits a contact angle of at least 150 degrees with a drop of water. Articles including a surface having a series of nano-sharp pore ridges defined by a series of pores and a sub-μm thick layer of a hydrophobic polymer on said surface.

9 Claims, 12 Drawing Sheets

(51) Int. Cl.
*C25D 11/08* (2006.01)
*C25D 11/10* (2006.01)
*C25D 11/26* (2006.01)

(52) U.S. Cl.
CPC ..... *C25D 11/26* (2013.01); *Y10T 428/12042* (2015.01); *Y10T 428/12049* (2015.01)

(56) References Cited

U.S. PATENT DOCUMENTS

| | | | | |
|---|---|---|---|---|
| 2009/0065645 | A1 | 3/2009 | Cini et al. | |
| 2009/0317590 | A1 | 12/2009 | Hwang et al. | |
| 2010/0028615 | A1 | 2/2010 | Hwang et al. | |
| 2011/0147219 | A1* | 6/2011 | Lambourne | C25D 11/18 205/50 |
| 2011/0229667 | A1 | 9/2011 | Jin et al. | |
| 2011/0250376 | A1* | 10/2011 | Aria | B82Y 30/00 428/97 |
| 2011/0304007 | A1 | 12/2011 | Watanabe | |

FOREIGN PATENT DOCUMENTS

| | | | | |
|---|---|---|---|---|
| WO | WO 2011094508 | A1 * | 8/2011 | C09D 5/1681 |
| WO | 2012087352 | | 6/2012 | |

OTHER PUBLICATIONS

"Wired Chemist", http://www.wiredchemist.com/chemistry/data/bond_energies_lengths.html, 2015, p. 1-4.*
ANSYS Inc., "ANSYS CFX-Solver Theory Guide", (2010) 13th ed. Retrieved on Oct. 8, 2013, from http://www1.ansys.com/customer/content/documentation/130/cfx_thry.pdf (390 pages).
Balasubramanian et al., "Microstructured hydrophobic skin for hydrodynamic drag reduction", AIAA J (2004) 42(2): 411-414.
Chen et al., "Nanograssed micropyramidal architectures for continuous dropwise condensation", Adv Funct Mater (2011) 21(24): 4617-4623.
Choi et al., "Direct numerical simulation of turbulent flow over riblets", J Fluid Mech (1993) 255: 503-539.
Choi et al., "Effective slip and friction reduction in nanograted superhydrophobic microchannels", Phys of Fluids (2006) 18(8): 087105. (8 pages).
Choi et al., "Large slip of aqueous liquid flow over a nanoengineered superhydrophobic surface", Phys Rev Lett (2006) 96(6): 066001. (4 pages).
Chu et al., "Large-scale fabrication of ordered nanoporous alumina films with arbitrary pore intervals by critical-potential anodization", J Electrochem. Soc (2006) 153(9): B384-391.
Elbing et al., "Bubble-induced skin-friction drag reduction and abrupt transition to air-layer drag reduction", J Fluid Mech (2008) 612: 201-236.
Fukuda et al., "Frictional drag reduction with air lubricant over a superwater-repellent surface", J Marine Sci Technol (2000) 5: 123-130.
Fukagata et al., "A theoretical prediction of friction drag reduction in turbulent flow by superhydrophobic surfaces", Phys of Fluids (18(5): 051703. (4 pages).
Gogte et al., "Effective slip on textured superhydrophobic surfaces", Phys of Fluids (2005) 17(5): 051701. (4 pages).
Gugliuzza et al., "Controlled pore size, thickness and surface free energy of super-hydrophobic PVDF® and Hyflon® AD membranes", Desalination (2006) 200: 26-28.
Hahn et al., "Direct numerical simulation of turbulent channel flow with permeable walls", J Fluid Mech (2002) 450: 259-285.
Kim et al., "Inclined-wall regular micro-pillar-arrayed surfaces covered entirely with an alumina nanowire forest and their improved superhydrophobicity", J Micromech Microeng (2011) 21: 075024. (9 pages).
Min et al., "Effects of hydrophobic surface on skin-friction drag", Phys of Fluids (2004) 16(7): L55-L58.
Ou et al., "Direct velocity measurements of the flow past drag-reducing ultrahydrophobic surfaces", Phys of Fluids (2005) 17(10): 103606. (10 pages).
Ou et al., "Laminar drag reduction in microchannels using ultrahydrophobic surfaces", Phys of Fluids (2004) 16(12): 4635-4660.
Sanders et al., "Bubble friction drag reduction in a high-Reynolds-number flat-plate turbulent boundary layer", J Fluid Mech 552: 353-380.
Sdougos et al., "Secondary flow and turbulence in a cone-and-plate device", J Fluid Mech (1984) 138: 379-404.
Virk, "Drag reduction fundamentals", AlChE J (1975) 21(4): 625-656.
Walsh, "Riblets", American Institute of Aeronautics and Astronautics, Inc. (1990) 123: 203-262.
Yanagishita et al., "Antireflection polymer surface using anodic porous alumina molds with tapered holes", Chem Lett (2007) 36(4): 530-531.

* cited by examiner

SUPERHYDROPHOBIC ANODIZED METALS AND METHOD OF MAKING SAME

CROSS-REFERENCES TO RELATED APPLICATIONS

This application claims benefit under 35 U.S.C. § 119(e) to U.S. Provisional Patent Application Ser. No. 61/715,864 filed on Oct. 19, 2012, which is hereby incorporated by reference in its entirety.

STATEMENT REGARDING FEDERALLY SPONSORED RESEARCH OR DEVELOPMENT

This invention was made with government support under Contract No. DE-AC05-00OR22725 awarded by the U.S. Department of Energy. The government has certain rights in the invention.

BACKGROUND OF THE INVENTION

1. Field of the Invention

The invention relates generally to superhydrophobic metals and more specifically to superhydrophobic anodized metals.

2. Description of the Related Art

Anodization of aluminum is a process of oxidization that results in the transformation of aluminum to alumina (aluminum oxide). This process typically results in the formation of from 10 nm diameter to 1000 nm diameter nanopores on the surface of alumina. A nanopore can be defined as a hole, dimple, or divot having a diameter of from 10 to 1000 nanometers. The formation, size and shape of these pores are determined by the anodization process chemistry, as well as, the particular material composition, i.e. pure aluminum or an aluminum alloy. These nanopores easily trap and hold liquid water and water vapor, which causes anodized alumina to be easily wetted. The nanopores, therefore, can increase viscous water drag and/or promote biofouling when submerged in ocean water. Submerged equipment that comprises aluminum and anodized alumina suffer from a variety of problems that include large viscous water drag (in the case of watercraft and vehicles), biofouling, saltwater-based corrosion, and general salt contamination. Therefore, a need exists for a modification to the standard aluminum anodization process to produce a durable superhydrophobic surface that is resistant to water drag, biofouling, corrosion, and contamination.

Drag reduction in water has always been of great interest since it can effectively reduce energy consumption and increase performance of watercraft. Studies have shown that the use of polymers, bubbles, air layers, permeable walls, or riblets could considerably reduce the hydrodynamic drag on a flat surface in turbulent flow. The most promising technologies, involving the addition of polymers and the injection of microbubbles into the flow, have been shown in the laboratory to reduce frictional drag by as much as 80%; however, none of these technologies have been transferred to the field successfully: the effectiveness of polymers degrades at high strain rate, and the microbubbles technique requires a very high void fraction of gas and a lot of energy to generate and inject the bubbles.

Superhydrophobic surfaces typically combine a hydrophobic material with surface structures with dimensions and spacing between 100 nm and 10 μm. Surface tension holds the water out of the surface features and effectively amplifies the hydrophobicity of the surface. A surface is generally called superhydrophobic when the contact angle of a drop of water on it is greater than or equal to 150 degrees. The drag reduction property of superhydrophobic surfaces comes from their ability to hold an air layer on their surface.

Although superhydrophobic surfaces have been shown to be capable of reducing drag over a large range of Reynolds number, there have been only a few efforts to design low-friction surfaces. Therefore, a need exists to design and fabricate a surface that would demonstrate large slip effects for continuous flow over a wide range of Reynolds number.

BRIEF SUMMARY OF THE INVENTION

Various embodiments relate to methods for producing a superhydrophobic anodized surface including anodizing a surface of a substrate in an anodization acid to form a plurality of pores, etching the surface with an etchant to widen an edge of each of the plurality of pores; repeatedly anodizing the surface in the anodization acid and etching the surface with the etchant until the edges of the plurality of pores overlap to form a plurality of nano-sharp ridges, and coating the surface with a hydrophobic polymer to render the surface superhydrophobic, such that the surface exhibits a contact angle of at least 150 degrees with a drop of water. Articles including a surface having a series of nano-sharp pore ridges defined by a series of pores and a sub-μm thick layer of a hydrophobic polymer on said surface. The surfaces can include aluminum, titanium, zinc, magnesium, niobium, zirconium, hafnium, tantalum, and combinations thereof.

BRIEF DESCRIPTION OF THE DRAWINGS

These and other features, aspects, and advantages of the present invention will become better understood with reference to the following description and appended claims, and accompanying drawings where:

Figure 1:
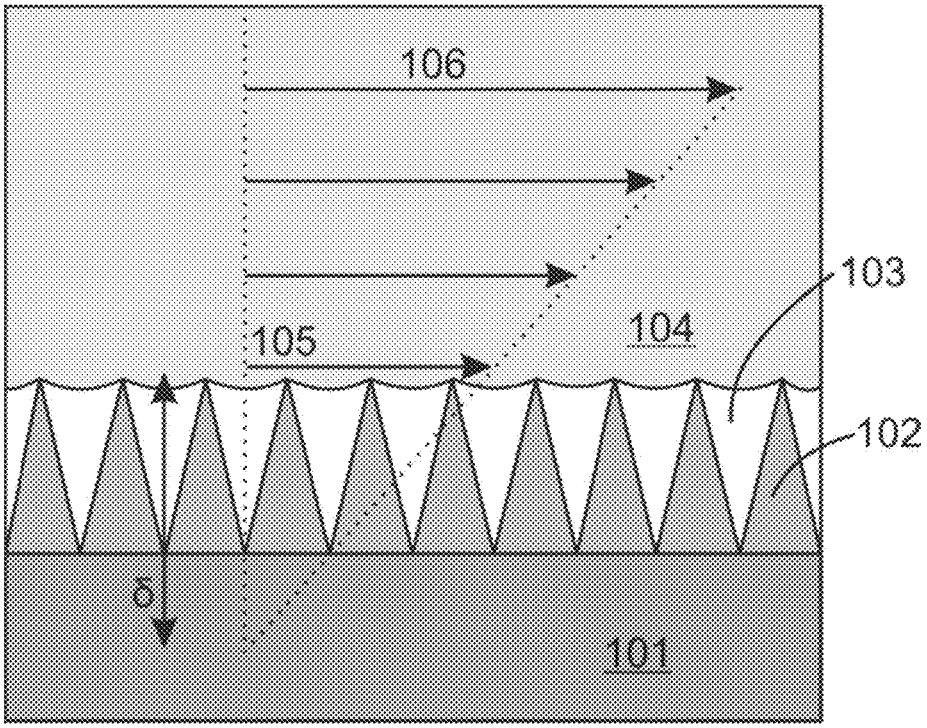
FIG. 1: is a schematic of the effective slip on a superhydrophobic surface, the velocity at the water-air interface is defined as the slip velocity.

It should be understood that the various embodiments are not limited to the arrangements and instrumentality shown in the drawings.

DETAILED DESCRIPTION OF THE INVENTION

The present invention may be understood more readily by reference to the following detailed description of preferred embodiments of the invention as well as to the examples included therein. All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

There are many potential applications and advantages of making anodized aluminum superhydrophobic, such as drag reduction of aluminum boats, and watercraft, anti-icing of commercial aircraft wings, self-cleaning aluminum mirrors, the reduction or elimination of biofouling on aluminum watercraft, and the reduction of elimination of saltwater, galvanic corrosion of aluminum structures, and many more. Various embodiments describe an aluminum anodization process for producing a durable superhydrophobic surface that can be resistant to water drag, biofouling, corrosion, and contamination. The resulting superhydrophobic anodized alumina surface can also be customized to have a variety of unique and commercially valuable characteristics. For example, the superhydrophobic alumina surface according to various embodiments can be made to exhibit anti-biofouling, anti-icing, and/or drag-reducing characteristics. Additionally, the superhydrophobic anodized aluminum, according to various embodiments, can be made into self-cleaning mirrors for use in telescopes and concentrated solar power applications.

By making watercraft, vehicles, and equipment superhydrophobic a layer of air can be pinned on the alumina's surface. When combined with riblets (grooves) in the substrate, significant viscous water drag reduction can be achieved. This air layer also inhibits biofouling, icing, and corrosion by blocking water, especially saltwater, from interacting with the aluminum substrate.

Various embodiments relate to a method for producing superhydrophobic anodized alumina. In addition to aluminum, other materials can be employed, including but not limited to titanium, zinc, magnesium, niobium, zirconium, hafnium, tantalum, and combinations thereof. The superhydrophobic anodized surface can include a micropatterned material selected from photolithographically-patterned silicon, photolithographically-patterned silicon nitride, and combinations thereof. Throughout the disclosure reference is most often made to aluminum, however, any of the above-mentioned materials may also be employed.

Various embodiments provide a surface demonstrating large slip effects for continuous flow over a wide range of Reynolds number. In order to get a large slip length, the ratio of the air-water interface to the water-microstructure walls must be as large as possible. Without riblets this ratio would typically range from 0.1 to 10. With the addition of riblets, the effective ratio range could expand to 1000 or more due to the air layer filling the entire riblet grooved area.

Figure 11:
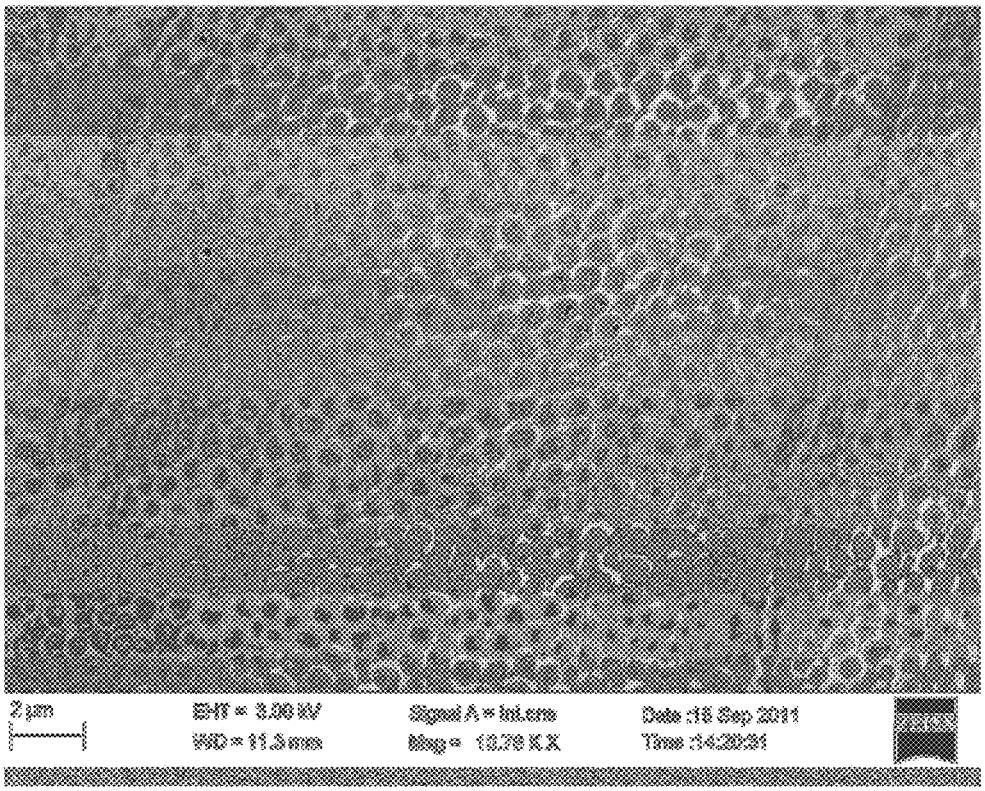
FIG. 11: shows an SEM image of the bottom of an anodized alumina groove.

According to various embodiments, a flared pores geometry can be employed, such that the air bubbles trapped in the flared pores would be hard to dislodge, thereby increasing the chance of observing drag reduction at high Reynolds number. FIG. 11 shows such a geometry where the pore is formed into a funnel. This funnel geometry was created by alternating between pore formation anodization and pore etching. The entire surface area of the aluminum was anodized in such a way as to produce tapered nanopore funnels with nano-ridges. When treated with a hydrophobic material, these nanopore funnels pin air in their pores and on their surfaces, thus becoming superhydrophobic.

The following nomenclature is used herein:

$r$ local radial position (m);

$\tilde{R}$ dimensionless parameter for the cone-and-plate flow;

$R_0$ cone radius;

$T$ torque on the rotating cone (N·m);

$(u_r, u_\theta, u_z)$ velocity components;

$\alpha$ cone angle (degree);

$\delta$ slip length (m);

$\mu$ water dynamic viscosity (Pa·s);

$\omega$ cone rotational speed (rad/s);

$\nu$ water kinematic viscosity ($m^2$·s); and $\tau_r\theta$ shear stress (Pa).

As shown in FIG. 1, a substrate wall 101 can be provided with a plurality of hydrophobic microstructures 102, which can pin air 103 between the hydrophobic microstructures 102 and a layer of water 104, allowing an effective slip boundary condition to exist between the water 104 and the plurality of hydrophobic microstructures 102. The slip boundary condition can be characterized by a slip length $\delta$. The velocity 105, 106 of the water 104 can be greater at larger slip lengths $\delta$. The large viscosity difference between the air and water causes the effective slip boundary condition at the wall characterized by a slip. Typically, a larger slip length results in a larger the drag reduction.

Although a slip boundary condition in the stream-wise (i.e. parallel to the flow) direction is definitely a source of drag reduction, a slip boundary condition in the span-wise direction (i.e. perpendicular to the flow) can cause a drag increase because of stronger quasi-stream-wise vortices. To minimize this effect, the nanopores can be combined with stream-wise oriented grooves; the grooves can be much larger (10 to 1,000 μm deep) than the nanopores (500-600 nm spacing). The grooves main purposes are to (i) decrease the drag by aligning the turbulent vortices and limiting the vortex interaction; (ii) increase the air layer thickness trapped in the surface; and (iii) decrease the slip effect in the span-wise direction.

Riblets

The method can, therefore, optionally include machining a plurality of riblets into the surface of the aluminum (or other metal) substrate. The plurality of riblets can have a depth within a range having a lower limit and/or an upper limit. The range can include or exclude the lower limit and/or the upper limit. The lower limit and/or upper limit can be selected from 1, 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790, 800, 810, 820, 830, 840, 850, 860, 870, 880, 890, 900, 910, 920, 930, 940, 950, 960, 970, 980, 990, 1000, 1010, 1020, 1030, 1040, 1050, 1060, 1070, 1080, 1090, 1100, 1110, 1120, 1130, 1140, 1150, 1160, 1170, 1180, 1190, 1200, 1210, 1220, 1230, 1240, 1250, 1260, 1270, 1280, 1290, 1300, 1310, 1320, 1330, 1340, 1350, 1360, 1370, 1380, 1390, 1400, 1410, 1420, 1430, 1440, 1450, 1460, 1470, 1480, 1490, 1500, 1510, 1520, 1530, 1540, 1550, 1560, 1570, 1580, 1590, 1600, 1610, 1620, 1630, 1640, 1650, 1660, 1670, 1680, 1690, 1700, 1710, 1720, 1730, 1740, 1750, 1760, 1770, 1780, 1790, 1800, 1810, 1820, 1830, 1840, 1850, 1860, 1870, 1880, 1890, 1900, 1910, 1920, 1930, 1940, 1950, 1960, 1970, 1980, 1990, and 2000 μm. For example, according to certain preferred embodiments, the plurality of riblets can have a depth of from 10 to 1,000 μm.

Anodization

The method can include anodizing a surface of an aluminum (or other metal) substrate in an anodization acid to form a plurality of aluminum oxide (or other metal oxide) pores. The anodization acid can be selected from the group consisting of sulfuric acid, nitric acid, oxalic acid, phosphoric acid, glycolic acid, tartaric acid, malic acid, citric acid, and combinations thereof.

Figure 2:
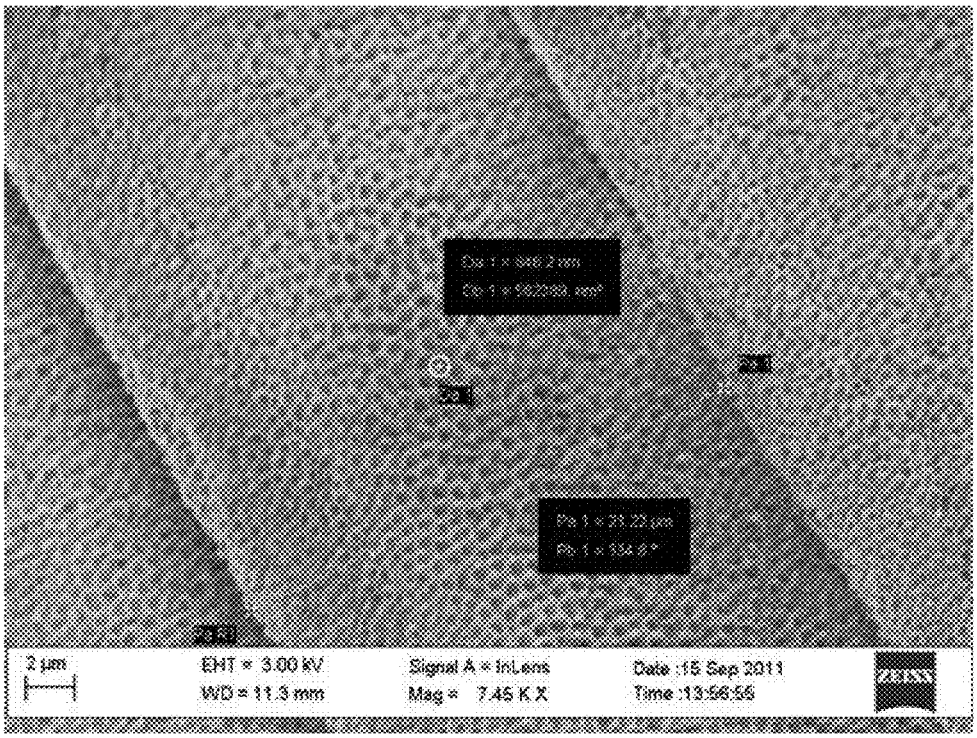
FIG. 2: shows scanning electron microscope (SEM) images of the superhydrophobic surfaces made by repeated anodization and etching of aluminum with 10 μm grooves.

Various anodiazation acids can be employed. For example, to create pores having an average diameter of less than 200 nm, or more specifically of about 100 nm, oxalic acid anodization can be employed. More specifically, a 2-step anodization process can be used to create highly ordered pores, as shown in FIG. 2. Smaller pores can be used to make optically transparent coatings for superhydrophobic mirrors.

The anodizing step can be performed at an anodization voltage within a range having a lower limit and/or an upper limit. The range can include or exclude the lower limit and/or the upper limit. The lower limit and/or upper limit can be selected from 1, 2, 3, 4, 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 285, 290, 295, 300, 305, 310, 315, 320, 325, 330, 335, 340, 345, 350, 355, 360, 365, 370, 375, 380, 385, 390, 395, 400, 405, 410, 415, 420, 425, 430, 435, 440, 445, 450, 455, 460, 465, 470, 475, 480, 485, 490, 495, 500, 505, 510, 515, 520, 525, 530, 535, 540, 545, 550, 555, 560, 565, 570, 575, 580, 585, 590, 595, 600, 605, 610, 615, 620, 625, 630, 635, 640, 645, 650, 655, 660, 665, 670, 675, 680, 685, 690, 695, 700, 705, 710, 715, 720, 725, 730, 735, 740, 745, 750, 755, 760, 765, 770, 775, 780, 785, 790, 795, 800, 805, 810, 815, 820, 825, 830, 835, 840, 845, 850, 855, 860, 865, 870, 875, 880, 885, 890, 895, 900, 905, 910, 915, 920, 925, 930, 935, 940, 945, 950, 955, 960, 965, 970, 975, 980, 985, 990, 995, and 1000 V. For example, according to certain preferred embodiments, the anodizing step can be performed at an anodization voltage of from 5 to 500 V.

There are several topography versions of the anodized aluminum (or other metal) that can be employed. The anodization can be carried out on a flat surface, which can provide larger features, such as larger pore sizes. The anodization can be carried out on a grooved surface, which can provide multiscale drag-reducing surfaces. Alternatively, as discussed above, grooved features (riblets) can be added to an anodized flat surface. Any of the surface features (i.e. with or without grooves) can be coated with an inert, non-nutrient, liquid, such as silicone oil to provide anti-fouling properties. In order to provide surfaces suitable for optical mirrors, the surfaces can be anodized with generally smaller features. If the features (e.g. pore features) are less than 200 nm, the features will be optically transparent throughout the visible and IR spectrum.

Pores

The plurality of pores, such as aluminum oxide (or other metal oxide) pores, can have an average diameter within a range having a lower limit and/or an upper limit. The range can include or exclude the lower limit and/or the upper limit. The lower limit and/or upper limit can be selected from 1, 100, 200, 300, 400, 500, 600, 700, 800, 900, 1000, 1100, 1200, 1300, 1400, 1500, 1600, 1700, 1800, 1900, 2000, 2100, 2200, 2300, 2400, 2500, 2600, 2700, 2800, 2900, 3000, 3100, 3200, 3300, 3400, 3500, 3600, 3700, 3800, 3900, 4000, 4100, 4200, 4300, 4400, 4500, 4600, 4700, 4800, 4900, 5000, 5100, 5200, 5300, 5400, 5500, 5600, 5700, 5800, 5900, 6000, 6100, 6200, 6300, 6400, 6500, 6600, 6700, 6800, 6900, 7000, 7100, 7200, 7300, 7400, 7500, 7600, 7700, 7800, 7900, 8000, 8100, 8200, 8300, 8400, 8500, 8600, 8700, 8800, 8900, 9000, 9100, 9200, 9300, 9400, 9500, 9600, 9700, 9800, 9900, 10000, 10100, 10200, 10300, 10400, 10500, 10600, 10700, 10800, 10900, 11000, 11100, 11200, 11300, 11400, 11500, 11600, 11700, 11800, 11900, 12000, 12100, 12200, 12300, 12400, 12500, 12600, 12700, 12800, 12900, 13000, 13100, 13200, 13300, 13400, 13500, 13600, 13700, 13800, 13900, 14000, 14100, 14200, 14300, 14400, 14500, 14600, 14700, 14800, 14900, and 15000 nm. For example, according to certain preferred embodiments, the plurality of aluminum oxide (or other metal oxide) pores can have an average diameter of from 1 to 10,000 nm.

Figure 14:
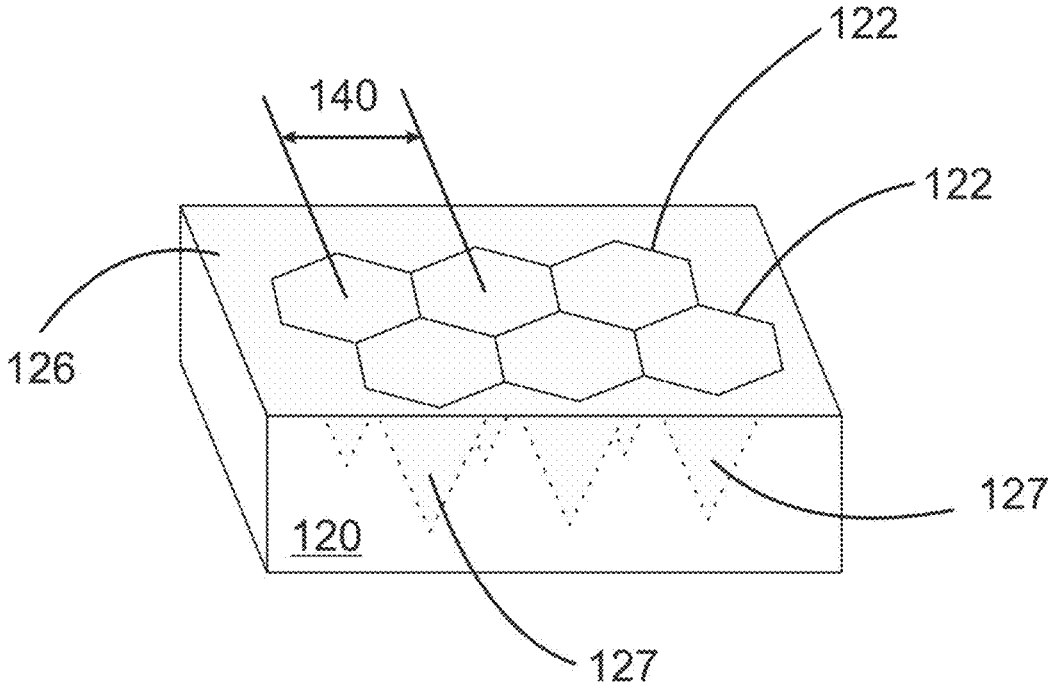
FIG. 14 is a schematic diagram of nanosharp ridges surrounding a plurality of pores according to various embodiments.

As illustrated in FIG. 14, the substrate 120 can be provided with a plurality of pores 127, each pore can adjoin adjacent pores at a plurality of nanosharp ridges 122 at the surface 126 of the substrate 120. The plurality of pores can adjoin each other in a hexagonal pattern. The plurality of pores can meet at a curved nanosharp ridge 122. The plurality of nanopores can be spaced at an average center-to-center distance from each other. The center-to-center distance can be within a range having a lower limit and/or an upper limit. The lower limit and/or upper limit can be selected from 1, 5, 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790, 800, 810, 820, 830, 840, 850, 860, 870, 880, 890, 900, 910, 920, 930, 940, 950, 960, 970, 980, 990, 1000, 1010, 1020, 1030, 1040, 1050, 1060, 1070, 1080, 1090, 1100, 1110, 1120, 1130, 1140, 1150, 1160, 1170, 1180, 1190, 1200, 1210, 1220, 1230, 1240, 1250, 1260, 1270, 1280, 1290, 1300, 1310, 1320, 1330, 1340, 1350, 1360, 1370, 1380, 1390, 1400, 1410, 1420, 1430, 1440, 1450, 1460, 1470, 1480, 1490, 1500, 1510, 1520, 1530, 1540, 1550, 1560, 1570, 1580, 1590, 1600, 1610, 1620, 1630, 1640, 1650, 1660, 1670, 1680, 1690, 1700, 1710, 1720, 1730, 1740, 1750, 1760, 1770, 1780, 1790, 1800, 1810, 1820, 1830, 1840, 1850, 1860, 1870, 1880, 1890, 1900, 1910, 1920, 1930, 1940, 1950, 1960, 1970, 1980, 1990, 2000, 2010, 2020, 2030, 2040, 2050, 2060, 2070, 2080, 2090, 2100, 2110, 2120, 2130, 2140, 2150, 2160, 2170, 2180, 2190, 2200, 2210, 2220, 2230, 2240, 2250, 2260, 2270, 2280, 2290, 2300, 2310, 2320, 2330, 2340, 2350, 2360, 2370, 2380, 2390, 2400, 2410, 2420, 2430, 2440, 2450, 2460, 2470, 2480, 2490, and 2500 nm. For example, according to certain preferred embodiments, the plurality of aluminum oxide (or other metal oxide) pores can be spaced from each other by an average distance of from about 10 to about 1500 nm. Alternatively, the center-to-center distance between each pore can be less than 100 nm. This distance is particularly effect for creating a mirrored surface. Pores less than 100 nm result in a good mirror surface since 100 nm is substantially smaller than the wavelength of visible light. The visible light spectra is defined as electromagnetic wavelengths in the range from 400 nm to 700 nm.

Etching

The method can further include etching the surface with an etchant to widen an edge of each of the plurality of aluminum oxide (or other metal oxide) pores.

The etchant can be a base selected from tetramethyl ammonium hydroxide, Sodium Hydroxide, Calcium Hydroxide, Magnesium Hydroxide, Ammonium Hydroxide, Chromium(III) Hydroxide, Platinum(IV) Hydroxide, Lead (II) Hydroxide, Beryllium Hydroxide, Vanadium(III) Hydroxide, Iron(II) Hydroxide, Silver Hydroxide, Strontium Hydroxide, Manganese(II) Hydroxide, Nickel Oxo-hydroxide, Copper(I) Hydroxide, Cadmium Hydroxide, Platinum (II) Hydroxide, Titanium(II) Hydroxide, Cobalt(II) Hydroxide, Barium Hydroxide Octahydrate, Manganese(III) Hydroxide, Bismuth(III) Hydroxide, Gold(I) Hydroxide, Thallium(I) Hydroxide, Titanium(IV) Hydroxide, Cesium Hydroxide, Boron Hydroxide, Palladium(II) Hydroxide, Lanthanum Hydroxide, Zirconium Hydroxide, Zirconium Tetrahydroxide, Ytterbium Hydroxide, Gallium(II) Hydroxide, Indium(II) Hydroxide, Aluminum Hydroxide, Barium Hydroxide, Potassium Hydroxide, Iron(III) Hydroxide, Zinc Hydroxide, Vanadium(V) Hydroxide, Copper(II) Hydroxide, Tin(IV) Hydroxide, Nickel(II) Hydroxide, Lead(IV) Hydroxide, Lithium Hydroxide, Tin(II) Hydroxide, Chromium(II) Hydroxide, Mercury(II) Hydroxide, Manganese(IV) Hydroxide, Titanium(III) Hydroxide, Cobalt(III) Hydroxide, Gallium(III) Hydroxide, Scandium Hydroxide, Nickel(III) Hydroxide, Gold Hydroxide, Mercury(I) Hydroxide, Radium Hydroxide, Thallium(III) Hydroxide, Hydroxide, Rubidium Hydroxide, Vanadium(II) Hydroxide, Neodymium Hydroxide, Uranyl Hydroxide, Yttrium Hydroxide, Indium(III) Hydroxide, Technetium(II) Hydroxide, Indium (I) Hydroxide and combinations thereof.

The etchant can be an acid selected from Sulfurous Acid, Hyposulfurous Acid, Pyrosulfuric Acid, Hyposulfurous Acid, Thiosulfurous Acid, Peroxydisulfuric Acid, Hydrochloric Acid, Chlorous Acid, Hyponitrous Acid, Nitric Acid, Carbonous Acid, Hypocarbonous Acid, Oxalic Acid, Phosphoric Acid, Hypophosphous Acid, Hydrobromic Acid, Bromous Acid, Hydroiodic Acid, Iodous Acid, Periodic Acid, Hydrophosphoric Acid, Chromous Acid, Perchromic Acid, Hydronitric Acid, Molybdic Acid, Selenic Acid, Silicofluoric Acid, Tellurous Acid, Xenic Acid, Formic Acid, Permanganic Acid, Antimonic Acid, Phthalic Acid, Silicic Acid, Arsenic Acid, Hypophosphoric Acid, Hydroarsenic Acid, Tetraboric Acid, Hypooxalous Acid, Cyanic Acid, Fluorous Acid, Malonic Acid, Hydrocyanic Acid, Sulfuric Acid, Persulfuric Acid, Disulfurous Acid, Tetrathionic Acid, Hydrosulfuric Acid, Perchloric Acid, Hypochlorous Acid, Chloric Acid, Nitrous Acid, Permitric Acid, Carbonic Acid, Percarbonic Acid, Acetic Acid, Phosphorous Acid, Perphosphoric Acid, Hypobromous Acid, Bromic Acid, Hypoiodous Acid, Iodic Acid, Hydrofluoric Acid, Chromic Acid, Hypochromous Acid, Hydroselenic Acid, Boric Acid, Perxenic Acid, Selenious Acid, Telluric Acid, Tungstic Acid, Citric Acid, Pyroantimonic Acid, Antimonious Acid, Hypofluorous Acid, Antimonous Acid, Titanic Acid, Perpechnetic Acid, Pyrophosphoric Acid, Dichromic Acid, metastannic Acid, Glutamic Acid, Silicous Acid, Ferricyanic Acid, Fluoric Acid, Thiocyanic Acid and combinations thereof.

The etchant can be preheated to a temperature within a range having a lower limit and/or an upper limit. The range can include or exclude the lower limit and/or the upper limit. The lower limit and/or upper limit can be selected from 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, 237, 238, 239, 240, 241, 242, 243, 244, 245, 246, 247, 248, 249, and 250 degrees Celsius. For example, according to certain preferred embodiments, the etchant can be preheated to a temperature of from 18 to 65 degrees Celsius.

Nanosharp Ridges

The method can optionally include repeatedly anodizing the surface in the anodization acid and etching the surface with the etchant until the edges of the plurality of aluminum oxide (or other metal oxide) pores overlap to form a plurality of nano-sharp ridges.

Figure 15:
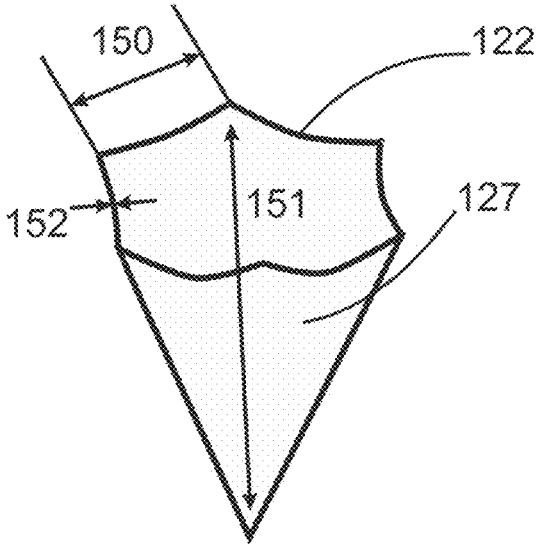
FIG. 15 is a schematic diagram of a single pore according to various embodiments.

As illustrated in FIG. 15, each of the plurality of nano-sharp ridges 122 associated with each of the plurality of pores 127 can have a width 152, a length 150, and a height 151 within a range having a lower limit and/or an upper limit. The range can include or exclude the lower limit and/or the upper limit. The lower limit and/or upper limit can be selected from 1, 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 285, 290, 295, 300, 305, 310, 315, 320, 325, 330, 335, 340, 345, 350, 355, 360, 365, 370, 375, 380, 385, 390, 395, 400, 405, 410, 415, 420, 425, 430, 435, 440, 445, 450, 455, 460, 465, 470, 475, 480, 485, 490, 495, 500, 505, 510, 515, 520, 525, 530, 535, 540, 545, 550, 555, 560, 565, 570, 575, 580, 585, 590, 595, 600, 605, 610, 615, 620, 625, 630, 635, 640, 645, 650, 655, 660, 665, 670, 675, 680, 685, 690, 695, 700, 705, 710, 715, 720, 725, 730, 735, 740, 745, 750, 755, 760, 765, 770, 775, 780, 785, 790, 795, 800, 805, 810, 815, 820, 825, 830, 835, 840, 845, 850, 855, 860, 865, 870, 875, 880, 885, 890, 895, 900, 905, 910, 915, 920, 925, 930, 935, 940, 945, 950, 955, 960, 965, 970, 975, 980, 985, 990, 995, and 1000 nm. For example, according to certain preferred embodiments, the plurality of nano-sharp ridges can each have a width, a length, and a height of from 1 to 500 nm. The width 152 is an indication of the sharpness of the point at which adjoining pores 127 meet.

As illustrated in FIG. 14, the substrate 120 can be provided with a plurality of pores 127, each pore can adjoin adjacent pores at a plurality of nanosharp ridges 122 at the surface 126 of the substrate 120. The plurality of pores can adjoin each other in a hexagonal pattern. The plurality of pores can meet at a curved nanosharp ridge 122.

Pores after Anodization and Etching

Figure 12:
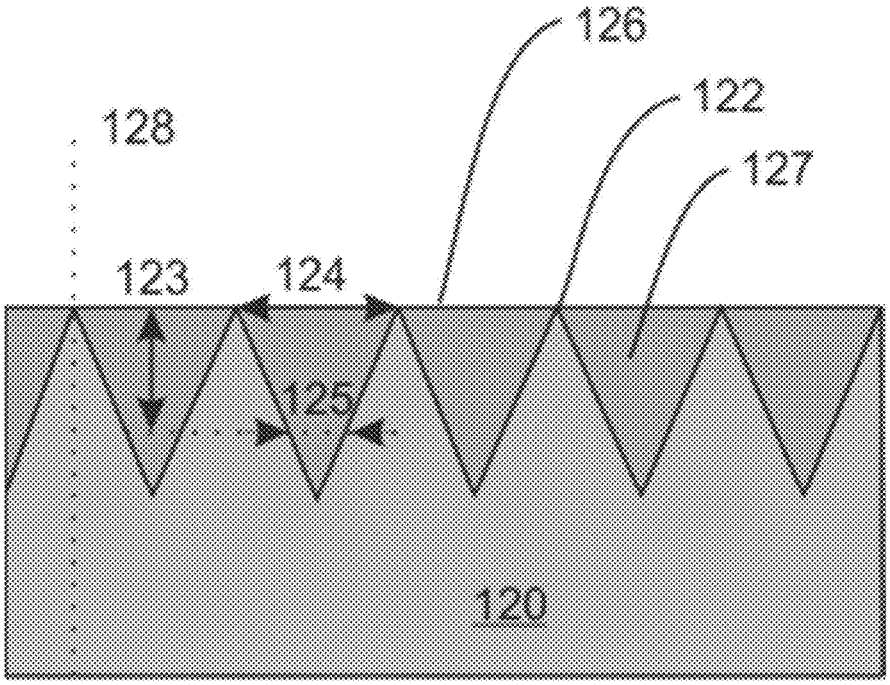
FIG. 12: shows a schematic diagram of nanosharp ridges according to various embodiments.

Referring to FIG. 12, the plurality of aluminum oxide (or other metal oxide) pores 127 can have a flared geometry. The flared geometry can have a decreasing diameter along an axis 128 perpendicular to the surface 126 of the substrate 120. The surface of the substrate can have an outermost point corresponding with one or more of the plurality of nanosharp ridges 122. The plurality of aluminum oxide (or other metal oxide) pores 127 each have a first diameter 124 at an outermost point on the surface and a second diameter 125 at a depth 123 beneath the outermost point on the surface.

The first diameter can have a length within a range having a lower limit and/or an upper limit. The range can include or exclude the lower limit and/or the upper limit. The lower limit and/or upper limit can be selected from 1, 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 285, 290, 295, 300, 305, 310, 315, 320, 325, 330, 335, 340, 345, 350, 355, 360, 365, 370, 375, 380, 385, 390, 395, 400, 405, 410, 415, 420, 425, 430, 435, 440, 445, 450, 455, 460, 465, 470, 475, 480, 485, 490, 495, 500, 505, 510, 515, 520, 525, 530, 535, 540, 545, 550, 555, 560, 565, 570, 575, 580, 585, 590, 595, 600, 605, 610, 615, 620, 625, 630, 635, 640, 645, 650, 655, 660, 665, 670, 675, 680, 685, 690, 695, 700, 705, 710, 715, 720, 725, 730, 735, 740, 745, 750, 755, 760, 765, 770, 775, 780, 785, 790, 795, 800, 805, 810, 815, 820, 825, 830, 835, 840, 845, 850, 855, 860, 865, 870, 875, 880, 885, 890, 895, 900, 905, 910, 915, 920, 925, 930, 935, 940, 945, 950, 955, 960, 965, 970, 975, 980, 985, 990, 995, 1000, 1005, 1010, 1015, 1020, 1025, 1030, 1035, 1040, 1045, 1050, 1055, 1060, 1065, 1070, 1075, 1080, 1085, 1090, 1095, 1100, 1105, 1110, 1115, 1120, 1125, 1130, 1135, 1140, 1145, 1150, 1155, 1160, 1165, 1170, 1175, 1180, 1185, 1190, 1195, 1200, 1205, 1210, 1215, 1220, 1225, 1230, 1235, 1240, 1245, and 1250 nm. For example, according to certain preferred embodiments, the first diameter can have a length of from 5 to 750 nm.

The second diameter can have a length within a range having a lower limit and/or an upper limit. The range can include or exclude the lower limit and/or the upper limit. The lower limit and/or upper limit can be selected from 1, 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 285, 290, 295, 300, 305, 310, 315, 320, 325, 330, 335, 340, 345, 350, 355, 360, 365, 370, 375, 380, 385, 390, 395, 400, 405, 410, 415, 420, 425, 430, 435, 440, 445, 450, 455, 460, 465, 470, 475, 480, 485, 490, 495, 500, 505, 510, 515, 520, 525, 530, 535, 540, 545, 550, 555, 560, 565, 570, 575, 580, 585, 590, 595, 600, 605, 610, 615, 620, 625, 630, 635, 640, 645, 650, 655, 660, 665, 670, 675, 680, 685, 690, 695, 700, 705, 710, 715, 720, 725, 730, 735, 740, 745, 750, 755, 760, 765, 770, 775, 780, 785, 790, 795, 800, 805, 810, 815, 820, 825, 830, 835, 840, 845, 850, 855, 860, 865, 870, 875, 880, 885, 890, 895, 900, 905, 910, 915, 920, 925, 930, 935, 940, 945, 950, 955, 960, 965, 970, 975, 980, 985, 990, 995, 1000, 1005, 1010, 1015, 1020, 1025, 1030, 1035, 1040, 1045, 1050, 1055, 1060, 1065, 1070, 1075, 1080, 1085, 1090, 1095, 1100, 1105, 1110, 1115, 1120, 1125, 1130, 1135, 1140, 1145, 1150, 1155, 1160, 1165, 1170, 1175, 1180, 1185, 1190, 1195, 1200, 1205, 1210, 1215, 1220, 1225, 1230, 1235, 1240, 1245, and 1250 nm. For example, according to certain preferred embodiments, the second diameter can have a length of from 1 to 500 nm.

The depth can be a distance beneath the outermost surface within a range having a lower limit and/or an upper limit. The range can include or exclude the lower limit and/or the upper limit. The lower limit and/or upper limit can be selected from 1, 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 285, 290, 295, 300, 305, 310, 315, 320, 325, 330, 335, 340, 345, 350, 355, 360, 365, 370, 375, 380, 385, 390, 395, 400, 405, 410, 415, 420, 425, 430, 435, 440, 445, 450, 455, 460, 465, 470, 475, 480, 485, 490, 495, 500, 505, 510, 515, 520, 525, 530, 535, 540, 545, 550, 555, 560, 565, 570, 575, 580, 585, 590, 595, 600, 605, 610, 615, 620, 625, 630, 635, 640, 645, 650, 655, 660, 665, 670, 675, 680, 685, 690, 695, 700, 705, 710, 715, 720, 725, 730, 735, 740, 745, 750, 755, 760, 765, 770, 775, 780, 785, 790, 795, 800, 805, 810, 815, 820, 825, 830, 835, 840, 845, 850, 855, 860, 865, 870, 875, 880, 885, 890, 895, 900, 905, 910, 915, 920, 925, 930, 935, 940, 945, 950, 955, 960, 965, 970, 975, 980, 985, 990, 995, 1000, 1005, 1010, 1015, 1020, 1025, 1030, 1035, 1040, 1045, 1050, 1055, 1060, 1065, 1070, 1075, 1080, 1085, 1090, 1095, 1100, 1105, 1110, 1115, 1120, 1125, 1130, 1135, 1140, 1145, 1150, 1155, 1160, 1165, 1170, 1175, 1180, 1185, 1190, 1195, 1200, 1205, 1210, 1215, 1220, 1225, 1230, 1235, 1240, 1245, and 1250 nm. For example, according to certain preferred embodiments, the depth can be a distance beneath the outermost surface of from 50 to 1000 nm.

Adhesion Promoter

The anodized alumina (or other metal) can be spin coated with an adhesion promoter such as hexamethyldisilazane (HMDS), or polydimethylsiloxane (PDMS). For the spin coating, a solution of the adhesion promoter in Propylene glycol monomethyl ether acetate (PGMEA) can be employed. For example, a solution of 1:4 HMDS:PGMEA can be employed in the spin coating. Indeed, the method can further include applying a solution of an adhesion promoter selected from the group consisting of hexamethyldisilazane (HMDS), polydimethylsiloxane (PDMS), (Tridecafluoro-1,1,2,2-tetrahydroctyl) trichlorosilane, Ethyltrichlorosilane, and combinations thereof. The spin coating with the adhesion promoter can react with and effectively remove any strongly bounded water.

Hydrophobic Polymer

To render the surface superhydrophobic, the nanosharp ridges can be coated with a hydrophobic coating. The anodized alumina can be baked for about 1.5 hours at 200 degrees Celsius and allowed to cool to remove loosely bound water. It is possible to replace the 1.5 hour 200 degree Celsius precoating bake with a 30 minute 50 W $O_2$ plasma clean.

Preferably, immediately after the optional application of an adhesion promoter, a 2% w/w solution of a hydrophobic polymer such as a fluoropolymer can be applied via spin coating at 1000 rpm. The solution of the hydrophobic polymer can have a concentration within a range having a lower limit and/or an upper limit. The range can include or exclude the lower limit and/or the upper limit. The lower limit and/or upper limit can be selected from 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.8, 3.9, 4, 4.1, 4.2, 4.3, 4.4, 4.5, 4.6, 4.7, 4.8, 4.9, 5, 5.1, 5.2, 5.3, 5.4, 5.5, 5.6, 5.7, 5.8, 5.9, 6, 6.1, 6.2, 6.3, 6.4, 6.5, 6.6, 6.7, 6.8, 6.9, 7, 7.1, 7.2, 7.3, 7.4, 7.5, 7.6, 7.7, 7.8, 7.9, 8, 8.1, 8.2, 8.3, 8.4, 8.5, 8.6, 8.7, 8.8, 8.9, 9, 9.1, 9.2, 9.3, 9.4, 9.5, 9.6, 9.7, 9.8, 9.9, 10, 10.1, 10.2, 10.3, 10.4, 10.5, 10.6, 10.7, 10.8, 10.9, 11, 11.1, 11.2, 11.3, 11.4, 11.5, 11.6, 11.7, 11.8, 11.9, 12, 12.1, 12.2, 12.3, 12.4, 12.5, 12.6, 12.7, 12.8, 12.9, 13, 13.1, 13.2, 13.3, 13.4, 13.5, 13.6, 13.7, 13.8, 13.9, 14, 14.1, 14.2, 14.3, 14.4, 14.5, 14.6, 14.7, 14.8, 14.9, and 15% w/w. For example, according to certain preferred embodiments, the solution of the hydrophobic polymer can have a concentration of from 0.1 to 10% w/w, or of from 0.5 to 5% w/w.

A suitable fluoropolymer is HYFLON®. It is preferable not to allow the adhesion promoter to dry. Next, the surface can be baked for 30 minutes at 75 degrees Celsius to drive off FLUORINERT™ solvent in which the HYFLON® was dissolved. FLUORINERT™ is an electrically insulating, stable fluorocarbon-based fluid available from 3M. Finally, the temperature can be ramped up to 150 degrees Celsius and baked for another 3 hours. The bake time can be reduced by increasing the temperature. For example, HYFLON® can be baked at 150 degrees Celsius for 3 Hours or at 300 degrees Celsius for 30 minutes. A temperature of 300 degrees Celsius should not be exceeded.

More specifically, the method can further include coating the surface with a hydrophobic polymer to render the surface superhydrophobic. The superhydrophobic surface can exhibits a contact angle with a drop of water within a range having a lower limit and/or an upper limit. The range can include or exclude the lower limit and/or the upper limit. The lower limit and/or upper limit can be selected from 150, 150.5, 151, 151.5, 152, 152.5, 153, 153.5, 154, 154.5, 155, 155.5, 156, 156.5, 157, 157.5, 158, 158.5, 159, 159.5, 160, 160.5, 161, 161.5, 162, 162.5, 163, 163.5, 164, 164.5, 165, 165.5, 166, 166.5, 167, 167.5, 168, 168.5, 169, 169.5, 170, 170.5, 171, 171.5, 172, 172.5, 173, 173.5, 174, 174.5, 175, 175.5, 176, 176.5, 177, 177.5, 178, 178.5, 179, 179.5, and 180 degrees. For example, according to certain preferred embodiments, the superhydrophobic surface can exhibits a contact angle with a drop of water of at least 150 degrees.

The hydrophobic polymer can conformally coat the plurality of aluminum oxide (or other metal oxide) pores. For purposes of the present disclosure, the term "conformally" designates an approximate mapping of a surface or region upon another surface so that all angles between intersecting curves remain approximately unchanged. The hydrophobic polymer can be a fluorinated polymer. The hydrophobic polymer can be selected from a polytetrafluoroethylene, an eethylenic-cyclo oxyaliphatic substituted ethylenic copolymer, a perfluoroalkoxy, and combinations thereof.

The hydrophobic polymer can be a continuous conformal hydrophobic coating. The continuous conformal hydrophobic coating can be a self-assembled monolayer (SAM). The nanostructured layer will be superhydrophobic only after a hydrophobic coating layer is applied thereto. Prior to application of the hydrophobic coating, the uncoated nanostructured layer will generally be hydrophilic. The hydrophobic coating layer can be a perfluorinated organic material, a self-assembled monolayer (like a silane), or both.

The hydrophobic coating can be continuously coated over all or a part of the spaced apart nanostructured features. According to most embodiments only a small amount of the surface is treated (covalently bonded) with this monolayer. Typically only 1% to 10% or the total surface area will be covalently bonded with the SAM. Once the amount of SAM approaches about 10%, the already bonded molecules can repel the additional ones trying to bond to the surface. The result is polymerization of the excess SAM that results in clumps of thick polymer sitting, unbounded, on the surface.

The coating can be formed as a self-assembled monolayer. Self-assembled monolayers (SAMs) are coatings consisting of a single layer of molecules on a surface, such as a surface of the nanostructured features. In a SAM, the molecules are arranged in a manner where a head group is directed toward or adhered to the surface, generally by the formation of at least one covalent bond, and a tail group is directed to the air interface to provide desired surface properties, such as hydrophobicity. As the hydrophobic tail group has the lower surface energy it dominates the air-surface interface providing a continuous surface of the tail groups.

Although SAM methods are described, it will be understood that alternate surface treatment techniques can be used. Additional exemplary surface treatment techniques include, but are not limited to, SAM; physical vapor deposition, e.g., sputtering, pulsed laser deposition, e-beam co-evaporation, and molecular beam epitaxy; chemical vapor deposition; and alternate chemical solution techniques.

SAMs useful in the instant invention can be prepared by adding a melt or solution of the desired SAM precursor onto the nanostructured layer where a sufficient concentration of SAM precursor is present to produce a continuous conformal monolayer coating. After the hydrophobic SAM is formed and fixed to the surface of the nanostructured layer, any excess precursor can be removed as a volatile or by washing. In this manner the SAM-air interface can be primarily or exclusively dominated by the hydrophobic moiety.

One example of a SAM precursor that can be useful for the compositions and methods described herein is tridecafluoro-1,1,2,2-tetrahydroctyltriclorosilane. In some instances, this molecule undergoes condensation with the silanol groups of the nanostructured layer, which releases HCl and covalently bonds the tridecafluoro-1,1,2,2-tetrahydroctylsilyls group to the silanols at the surface of the porous particle. The tridecafluorohexyl moiety of the tridecafluoro-1,1,2,2-tetrahydroctylsilyl groups attached to the surface of the nanostructured layer provides a monomolecular layer that has a hydrophobicity similar to polytetrafluoroethylene. Thus, such SAMs make it possible to produce a nanostructured layer 14 having hydrophobic surfaces while retaining the desired nanostructured morphology that produces the desired superhydrophobic properties.

A non-exclusive list of exemplary SAM precursors that can be used for various embodiments of the invention is:

$$X_y(CH_3)_{(3-y)}SiLR$$

where y=1 to 3; X is Cl, Br, I, H, HO, R'HN, $R'_2N$, imidizolo, R'C(O)N(H), R'C(O)N(R"), R'O, $F_3CC(O)N(H)$, $F_3CC(O)N(CH_3)$, or $F_3S(O)_2O$, where R' is a straight or branched chain hydrocarbon of 1 to 4 carbons and R" is methyl or ethyl; L, a linking group, is $CH_2CH_2$, $CH_2CH_2CH_2$, $CH_2CH_2O$, $CH_2CH_2CH_2O$, $CH_2CH_2C(O)$, $CH_2CH_2CH_2C(O)$, $CH_2CH_2OCH_2$, $CH_2CH_2CH_2OCH_2$; and R is $(CF_2)_nCF_3$ or $(CF(CF_3)OCF_2)_nCF_2CF_3$, where n is 0 to 24. Preferred SAM precursors have y=3 and are commonly referred to as silane coupling agents. These SAM precursors can attach to multiple OH groups on the surface and can link together with the consumption of water, either residual on the surface, formed by condensation with the surface, or added before, during or after the deposition of the SAM precursor. All SAM precursors yield a most thermodynamically stable structure where the hydrophobic moiety of the molecule is extended from the surface and establish normal conformational populations which permit the hydrophobic moiety of the SAM to dominate the air interface. In general, the hydrophobicity of the SAM surface increases with the value of n for the hydrophobic moiety, although in most cases sufficiently high hydrophobic properties are achieved when n is about 4 or greater where the SAM air interface is dominated by the hydrophobic moiety. The precursor can be a single molecule or a mixture of molecules with different values of n for the perfluorinated moiety. When the precursor is a mixture of molecules it is preferable that the molecular weight distribution is narrow, typically a Poisson distribution or a more narrow distribution.

The SAM precursor can have a non-fluorinated hydrophobic moiety as long as the SAM precursor readily conforms to the nanostructured features of the nanostructured layer and exhibits a sufficiently low surface energy to exhibit the desired hydrophobic properties. Although fluorinated SAM precursors may be preferred, in some embodiments of the invention silicones and hydrocarbon equivalents for the R groups of the fluorinated SAM precursors above can be used. Additional details regarding SAM precursors and methodologies can be found in the patent applications that have been incorporated herein by reference.

Pinned Oil

Figure 13:
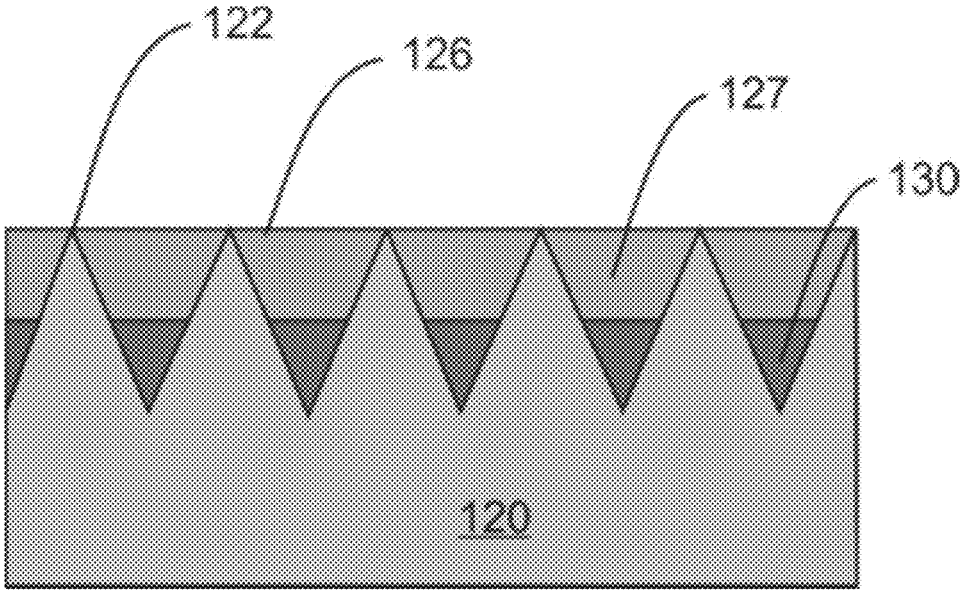
FIG. 13: shows a schematic diagram of a superhydrophobic surface with pinned oil.

As shown in FIG. 13, a silicon-based non-nutrient oil 130 can be pinned within the nanopores 127 of the substrate 120. The pinned oil can be positioned below the surface 126 of the substrate 120 and beneath the nanosharp ridges 122. When a silicon-based non-nutrient oil 130 is so pinned, the surface 126 of the substrate 120 can exhibit anti-biofouling behavior. Since the oil is a non-compressible fluid, it can withstand very high pressures without degrading or debonding.

As used herein, "oil" is intended to refer to a non-polar fluid that is a stable, non-volatile, liquid at room temperature, e.g., 23-28 degrees Celsius. The oils used herein should be incompressible and have no solubility or only trace solubility in water, e.g., a solubility of 0.01 g/l or 0.001 g/l or less. Exemplary oils include non-volatile linear and branched alkanes, alkenes and alkynes, esters of linear and branched alkanes, alkenes and alkynes; polysiloxanes, and combinations thereof.

The oil 130 pinned by and/or within the nanopores 127 can be a non-nutritional oil. As used herein, the term "non-nutritional" is used to refer to oils that are not consumed as a nutrient source by microbes, e.g., bacteria, fungus, etc., or other living organisms. Exemplary non-nutritional oils include, but are not limited to polysiloxanes. The superhydrophobic surfaces described herein maintain their superhydrophobic properties much longer than equivalent surfaces that do not include the pinned oil described herein. The presence of oil pinned in the nanopores produces superhydrophobic surfaces with exceptionally durable superhydrophobic, anti-corrosive and anti-fouling properties.

The oil can be pinned in all or substantially all of the nanopores and/or surface nanopores.

The oil can be pinned in a percentage of the nanopores. The percentage can be within a range having a lower limit and/or an upper limit. The range can include or exclude the lower limit and/or the upper limit. The lower limit and/or upper limit can be selected from 60, 60.5, 61, 61.5, 62, 62.5, 63, 63.5, 64, 64.5, 65, 65.5, 66, 66.5, 67, 67.5, 68, 68.5, 69, 69.5, 70, 70.5, 71, 71.5, 72, 72.5, 73, 73.5, 74, 74.5, 75, 75.5, 76, 76.5, 77, 77.5, 78, 78.5, 79, 79.5, 80, 80.5, 81, 81.5, 82, 82.5, 83, 83.5, 84, 84.5, 85, 85.5, 86, 86.5, 87, 87.5, 88, 88.5, 89, 89.5, 90, 90.5, 91, 91.5, 92, 92.5, 93, 93.5, 94, 94.5, 95, 95.5, 96, 96.5, 97, 97.5, 98, 98.5, 99, 99.5, and 100 percent. For example, oil can be pinned in at least 70%, at least 80%, at least 90%, at least 95%, at least 97.5%, or at least 99% of the nanopores and/or surface nanopores.

The oil can be an oil that does not evaporate at ambient environmental conditions. An exemplary oil can have a boiling point of at least 120° C., or at least 135° C., or at least 150° C. or at least 175° C. Alternatively, the oil can be oil that evaporates when exposed to ambient environmental conditions. An exemplary oil can have a boiling point boiling point of 135° C. or less, or 120° C. or less, or 100° C. or less, or 80° C. or less.

As used herein, "ambient environmental conditions" refer generally to naturally occurring terrestrial or aquatic conditions to which superoleophilic materials may be exposed. For example, submerged in lakes, rivers and oceans around the world, and adhered to manmade structures around the world. Exemplary ambient environmental conditions include (i) a temperature range from −40° C. to 45° C. at a pressure of one atmosphere, and (ii) standard temperature and pressure.

Article

Various embodiments relate to an article including a surface having a series of nano-sharp pore ridges defined by a series of aluminum oxide pores and a sub-μm thick layer of a hydrophobic polymer on said surface.

The surface can include aluminum, titanium, zinc, magnesium, niobium, zirconium, hafnium, tantalum, and combinations thereof. The surface can include a micropatterned material selected from photolithographically-patterned silicon, photolithographically-patterned silicon nitride, and combinations thereof.

As illustrated in FIG. 15, each of the plurality of nanosharp ridges 122 associated with each of the plurality of pores 127 can have a width 152, a length 150, and a height 151 within a range having a lower limit and/or an upper limit. The range can include or exclude the lower limit and/or the upper limit. The lower limit and/or upper limit can be selected from 1, 5, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 285, 290, 295, 300, 305, 310, 315, 320, 325, 330, 335, 340, 345, 350, 355, 360, 365, 370, 375, 380, 385, 390, 395, 400, 405, 410, 415, 420, 425, 430, 435, 440, 445, 450, 455, 460, 465, 470, 475, 480, 485, 490, 495, 500, 505, 510, 515, 520, 525, 530, 535, 540, 545, 550, 555, 560, 565, 570, 575, 580, 585, 590, 595, 600, 605, 610, 615, 620, 625, 630, 635, 640, 645, 650, 655, 660, 665, 670, 675, 680, 685, 690, 695, 700, 705, 710, 715, 720, 725, 730, 735, 740, 745, 750, 755, 760, 765, 770, 775, 780, 785, 790, 795, 800, 805, 810, 815, 820, 825, 830, 835, 840, 845, 850, 855, 860, 865, 870, 875, 880, 885, 890, 895, 900, 905, 910, 915, 920, 925, 930, 935, 940, 945, 950, 955, 960, 965, 970, 975, 980, 985, 990, 995, and 1000 nm. For example, according to certain preferred embodiments, the plurality of nano-sharp ridges can each have a width, a length, and a height of from 1 to 500 nm.

The hydrophobic coating can be as described above. The coating can be hydrophobic polymer, which can be a fluorinated polymer. The hydrophobic polymer can be selected from a polytetrafluoroethylene, an eethylenic-cyclo oxyaliphatic substituted ethylenic copolymer, a perfluoroalkoxy, and combinations thereof.

The article can further include a plurality of riblets in the surface. The riblets can have the dimensions as previously stated. The plurality of aluminum oxide pores can have a flared geometry as previously described.

Various other embodiments relate to products including the article according to or produced by other embodiments. The products can include, but are not limited to a marine vehicle, a mirror, a torpedo, a water pipe, a component of a tidal energy system, and combinations thereof.

Various embodiments relate to mirrors including the article according to or produced by other embodiments. The mirrors can be produced from polished aluminum or polished metal. Anodization can be done on small scale pores as small as just a few nanometers that are closely spaced. The aluminum or alumina can still look very polished and very much like a mirror to visible light if the aluminum/alumina surface features are much smaller than the incident light's wavelength.

As illustrated in FIG. 14, the substrate 120 can be provided with a plurality of pores 127, each pore can adjoin adjacent pores at a plurality of nanosharp ridges 122 at the surface 126 of the substrate 120. The plurality of pores can adjoin each other in a hexagonal pattern. The plurality of pores can meet at a curved nanosharp ridge 122. The plurality of nanopores can be spaced at an average center-to-center distance from each other. The center-to-center distance can be within a range having a lower limit and/or an upper limit. The lower limit and/or upper limit can be selected from 1, 5, 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790, 800, 810, 820, 830, 840, 850, 860, 870, 880, 890, 900, 910, 920, 930, 940, 950, 960, 970, 980, 990, 1000, 1010, 1020, 1030, 1040, 1050, 1060, 1070, 1080, 1090, 1100, 1110, 1120, 1130, 1140, 1150, 1160, 1170, 1180, 1190, 1200, 1210, 1220, 1230, 1240, 1250, 1260, 1270, 1280, 1290, 1300, 1310, 1320, 1330, 1340, 1350, 1360, 1370, 1380, 1390, 1400, 1410, 1420, 1430, 1440, 1450, 1460, 1470, 1480, 1490, 1500, 1510, 1520, 1530, 1540, 1550, 1560, 1570, 1580, 1590, 1600, 1610, 1620, 1630, 1640, 1650, 1660, 1670, 1680, 1690, 1700, 1710, 1720, 1730, 1740, 1750, 1760, 1770, 1780, 1790, 1800, 1810, 1820, 1830, 1840, 1850, 1860, 1870, 1880, 1890, 1900, 1910, 1920, 1930, 1940, 1950, 1960, 1970, 1980, 1990, 2000, 2010, 2020, 2030, 2040, 2050, 2060, 2070, 2080, 2090, 2100, 2110, 2120, 2130, 2140, 2150, 2160, 2170, 2180, 2190, 2200, 2210, 2220, 2230, 2240, 2250, 2260, 2270, 2280, 2290, 2300, 2310, 2320, 2330, 2340, 2350, 2360, 2370, 2380, 2390, 2400, 2410, 2420, 2430, 2440, 2450, 2460, 2470, 2480, 2490, and 2500 nm. For example, according to certain preferred embodiments, the plurality of aluminum oxide (or other metal oxide) pores can be spaced from each other by an average distance of from about 10 to about 1500 nm. Alternatively, the center-to-center distance between each pore can be less than 100 nm. This distance is particularly effect for creating a mirrored surface. Pores less than 100 nm result in a good mirror surface since 100 nm is substantially smaller than the wavelength of visible. The visible light spectra is defined as electromagnetic wavelengths in the range from 400 nm to 700 nm. According to certain preferred embodiments, the series of aluminum oxide pores can be spaced from each other by an average distance of from 130 to 980 nm.

EXAMPLES

The following examples describe the fabrication process of a multi-scale superhydrophobic surface that combines large μm-grooves and nanopores, and the experimental method with a cone-and-plate rheometer to test their drag reduction properties. In Examples 1 to 3 samples combining riblets and superhydrophobic surfaces were fabricated and their drag reduction properties studied with a commercial cone-and-plate rheometer. In Examples 4 to 5, parallel to the experiments, Computational Fluid Dynamics (CFD) numerical simulations were performed in order to estimate the slip length at higher rotational speed.

For each sample, a drag reduction of at least 5% is observed in both laminar and turbulent regime. At low rotational speed, drag reduction up to 30% is observed with a 1 mm deep grooved sample. As the rotational speed increases, a secondary flow develops causing a slight decrease in drag reductions. However, drag reduction above 15% is still observed for the large grooved samples. In the turbulent regime, the 100 μm grooved sample becomes more efficient than the other samples in drag reduction and manages to sustain a drag reduction above 15%. Using the simulations, the slip length of the 100 μm grooved sample is estimated to be slightly above 100 μm in the turbulent regime.

The superhydrophobic material fabrication technique was chosen based on the need to make 4 inch diameter disk samples that can be easily tested in the available rheometer.

Examples 1-3

Annealed high purity aluminum disks, comprising 99.9995% aluminum by weight, were cut flat to a thickness of about 10 nm by single point diamond turning. Next, a series of concentric grooves (or riblets) were cut into the sample with a 90 degree dead sharp diamond tool. Three different depths of grooves were tested: 10 μm, 100 μm, and 1,000 μm, in Examples 1-3, respectively.

The surface structures which contribute to the superhydrophobic surface were formed by a series of anodizing steps in citric which alternate with etching steps in tetramethyl ammonium hydroxide. The anodizing steps created aluminum oxide pores with about 130 to 980 nm spacing, depending on electrolyte and anodization voltage, which grew into the aluminum substrate, while the etching widened the pore at each step. The electrolyte used was 0.1175 Molar Citric Acid at an anodization voltage of 320V. To produce smaller surface features, 0.3 Molar Oxalic at an anodization voltage of 40V is particularly preferred.

A variety of electrolytes can be employed, including sulfuric acid, oxalic acid, phosphoric acid, glycolic acid, tartaric acid, malic acid, and citric acid. The anodization voltage to be used can vary depending on the electrolyte used. An anodization voltage of from 8 to 70 V can be used when the electrolyte is sulfuric acid. An anodization voltage of from 40 to 160 V can be used when the electrolyte is Oxalic acid. An anodization voltage of from 60 to 235 V can be used when the electrolyte is phosphoric acid. An anodization voltage of from 60 to 150 V can be used when the electrolyte is glycolic acid. An anodization voltage of from 235 to 240 V can be used when the electrolyte is tartaric acid. An anodization voltage of from 220 to 450 V can be used when the electrolyte is malic acid. An anodization voltage of from 270 to 370 V can be used when the electrolyte is citric acid.

The combined effect created flared aluminum oxide pores, where the pores were wide at the surface and narrow as they go deeper into the substrate. In each Example, a point was reached where the flared edge of one pore starts to overlap the flared outer edge of the adjacent pores. At that point, the surface can be thought of as having nano-sharp pore ridges which is not only very important for the creation of a superhydrophobic surface, but is also one of the unique features of this invention.

A solution of HMDS (Hexamethyldisilazane) was use to dry out the porous surface and change its chemistry from hydrophilic to hydrophobic and at the same time remove loosely bound water from the aluminum pores. This step can be important in that it keeps the subsequently applied fluoropolymer from debonding and thus greatly enhances the coating's ability to keep an air layer pinned (i.e. a dewetted surface) for long durations while being submerged. More specifically, HMDS was used in 1:4 by volume solution with PGMEA. The solution of HMDS was obtained from Acros Organics and had the following characteristics: 1250585000 MW; 161.4 g/mol; density 0.76 g/ml; Molarity=0.979 mol/L.

Finally, the samples were spin-coated with a sub-micrometer thick layer of HYFLON® AD 60. HYFLON® AD 60 is a Perfluoropolymer (Perfluoropolymer) hydrophobic polymer supplied by Solvay Specialty Polymers. The sub-micrometer thick layer of HYFLON® AD 60 conformally coated the structure and left the surface superhydrophobic. For purposes of the present disclosure, the term "conformally" designates an approximate mapping of a surface or region upon another surface so that all angles between intersecting curves remain approximately unchanged.

Figure 3:
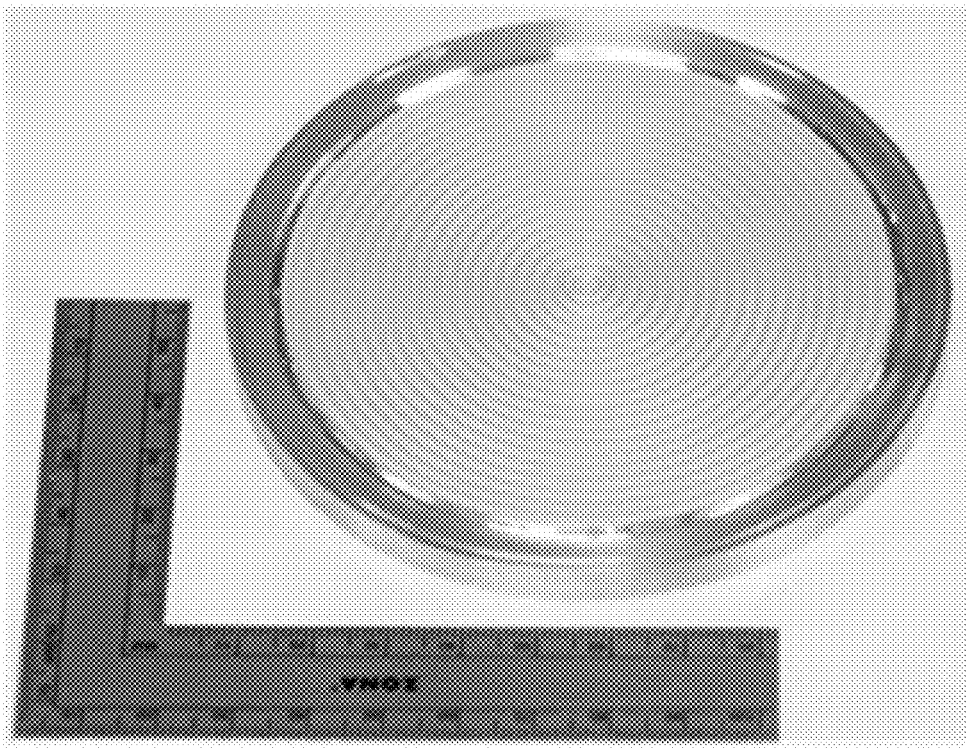
FIG. 3: is a photograph of a multiscale superhydrophobic surface with 1 mm deep grooves.
Figure 4:
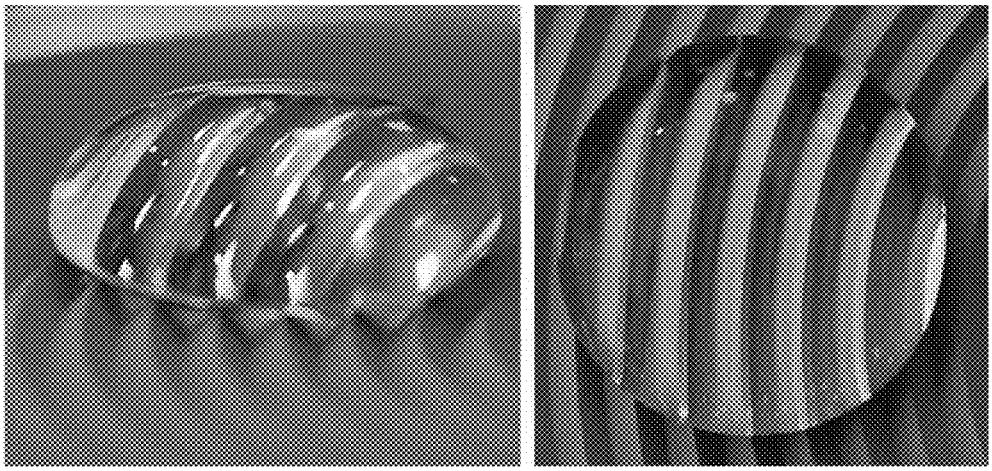
FIG. 4: is a top and side picture of a large drop on the 1 mm deep grooves sample.

A major advantage of this fabrication method is that the nano structures needed for the superhydrophobic surface can be generated on any aluminum substrate, whether it is flat, grooved, or any other conceivable pattern. Furthermore, due to the anodizing and etching process, the nanopores are always perpendicular to the substrate surface, guaranteeing a high quality superhydrophobic surface. The combination of nanopores and the Hyflon coatings was found to be quite robust and makes an excellent choice for a drag reduction technique. A photograph of the sample with the 1 mm grooves is shown in FIGS. 3 and 4.

The drag reduction properties of the samples are tested with a commercial cone-and-plate rheometer (AR 2000, TA Instruments). The rheometer is capable of measuring torque ranging from $10^{-7}$ to 0.2 N·m with a resolution of $10^{-9}$ N·m, and varying the rotational speed ω from 0 to 300 rad/s. A stainless-steel cone with 60 mm diameter, 2 degree angle, and 51 μm in truncation is used. The multiscale superhydrophobic samples are used as bottom plates. The experiments are conducted as follows: (1) distilled water is pipetted with an exact volume of 1.98±0.01 mL on the sample; (2) the cone is lowered to the correct height; (3) any excess of water is carefully removed with a cotton swab (it happens only with the 100 μm and 1,000 μm grooved samples); (4) a first series of measurements is performed with ω ranging from 2 to 6 rad/s with a 0.5 rad/s increment; (5) a second series of measurements is performed for larger ω ranging from 6 to 70 rad/s with a 4 rad/s increment. In most cases, the experiment is stopped at lower speed than 70 rad/s as the water is being squeezed out of the cone-and-plate region.

The main source of uncertainties in the measurements comes from step 3, where the excess of water is removed for the 100 and 1,000 μm grooved sample. The large pocket of air trapped in the grooves (see FIG. 4) causes a small amount of water to be squeezed out of the cone-and-plate space. The excess of water is removed with a small cotton swab, taking care that the meniscus remained in a good shape for the measurements. This uncertainty could be minimized in the future by using a ring trench where the excess of water could collect. Another source of error comes from viscous heating, which can affect the water viscosity, and thus the torque on the cone. It is estimated that a 0.1° C. increase of temperature could generate an overestimation of the slip length by 2 μm, which is relatively small compared to the slip lengths measured in this study. Finally, some error could arise from any misalignment between the concentric grooves and the cone axis.

Examples 4-6

In this example, Computational Fluid Dynamics (CFD) numerical simulations were performed in order to estimate the slip length at higher rotational speed. Three different depths of grooves were tested: 10 μm, 100 μm, and 1,000 μm, in Examples 4-6, respectively.

The flow in a cone-and-plate device can be described with a single dimensionless parameter as shown in Equation (1):

$$\tilde{R} = \frac{r^2\omega\alpha^2}{12\nu} \tag{1}$$

where α is the cone angle, r the radial position, and ν the water kinematic viscosity. This parameter can be interpreted as the ratio of the centrifugal force to the viscous forces acting on the fluid. When $\tilde{R}$ is small enough, the centrifugal forces are very small, and thus the radial velocity is zero everywhere. The streamlines are then concentric, and the surface shear stress on the cone is constant and can be expressed as shown in Equation (2):

$$\tau_{r\theta} = \mu\frac{\partial u_\theta}{\partial z} = \mu\frac{\omega r}{r\tan\alpha + \delta} = \frac{\mu\omega}{\alpha}\left(1 - \frac{\delta}{r\alpha} + \left(\frac{\delta}{r\alpha}\right)^2 + O\left(\left(\frac{\delta}{r\alpha}\right)^3\right)\right) \tag{2}$$

The torque T on the rotating cone can then be calculated as shown in Equation (3):

$$T = \int_0^{R_0} 2\pi r^2\tau_{r\theta}\,dr = \frac{2\pi}{3}\frac{\mu\omega R_0^3}{\alpha}\left(1 - \frac{3\delta}{2R_0\alpha} + \frac{3\delta^2}{R^2\alpha^2} + O\left(\left(\frac{\delta}{r\alpha}\right)^3\right)\right) \tag{3}$$

As the rotational speed increases, the centrifugal force promotes a radial fluid motion towards the periphery of the device causing a secondary flow. The streamlines are then no longer concentric. The transition to turbulence occurs for $\tilde{R} \geq 4$, which corresponds in our experiments at about 44 rad/s. In order to estimate the slip length at higher rotational speed, the Navier Stokes equations are solved without any turbulence model (Direct Numerical Simulation or DNS). The mesh is refined enough to resolve the Kolmogorov scale. The numerical simulations are carried out with the commercial code ANSYS-CFX on a workstation with two six-core Intel Xeon X5650 processors and 24 Gb of RAM. The cone-and-plate flow is computed on a wedge-like domain of 13 degrees with the following boundary conditions: (a) shear free condition for the free surface at the outer rim; (b) periodic boundary conditions at the lateral domain boundaries; (c) rω circumferential velocities at the cone; and (d) slip condition with a given slip length on the superhydrophobic surface. Rotational speeds ranging from 2 to 80 rad/s and slip lengths varying from 0 to 200 μm were used.

The sources of uncertainties in the simulations are mainly from the boundary conditions. First, in order to keep the mesh size reasonable, a wedge-like domain with periodic boundary conditions is used rather than the whole cone-and-plate. The wedge-like domain angle 13 degrees is relatively large compared to the cone angle (2 degrees). However, the periodic boundary conditions are probably not reasonable in turbulent regime and may cause a relaminarization of the flow. Another source of uncertainty is the shear-free boundary condition used for the meniscus, which does not take into account the free surface deformation and the possible variations in the contact angle at surface. Based on comparison with the measurements using the control disks, the error on the cone torque is estimated to be less than 4%.

Results in Laminar Regime

Figure 5:
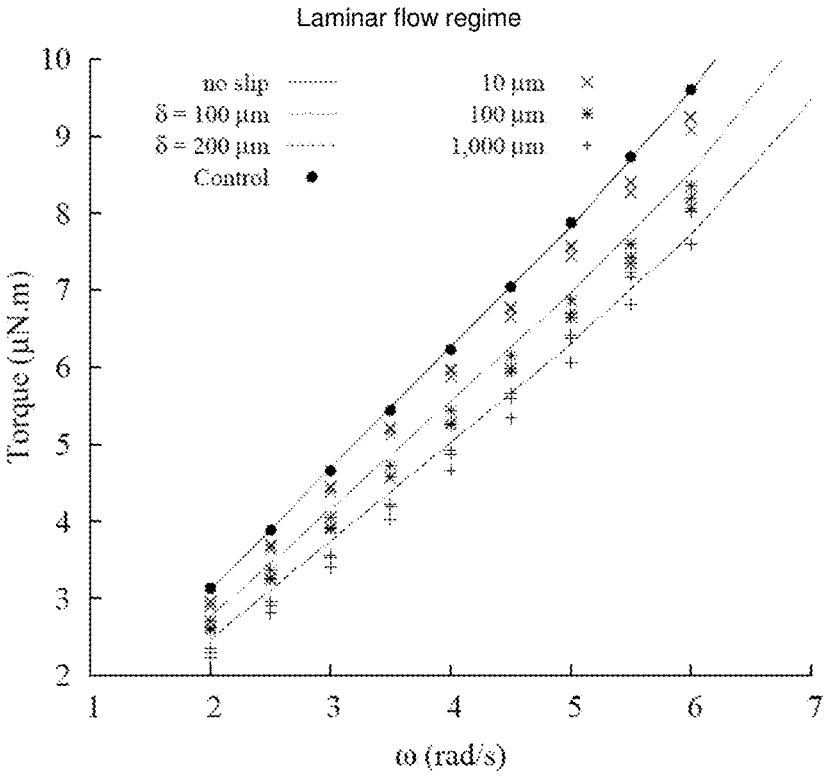
FIG. 5: is a plot showing torque measured on the cone in the laminar regime for different samples (markers) and torque computed with the CFD simulations for different slip lengths.

In laminar regimes, the results are fairly simple: the deeper the grooves, the less the torque. FIG. 5 shows the torque applied on the cone for rotational speeds varying from 2 to 6 rad/s, with three different groove sizes and a control disk (no groove and no hydrophobic coating).

Figure 6:
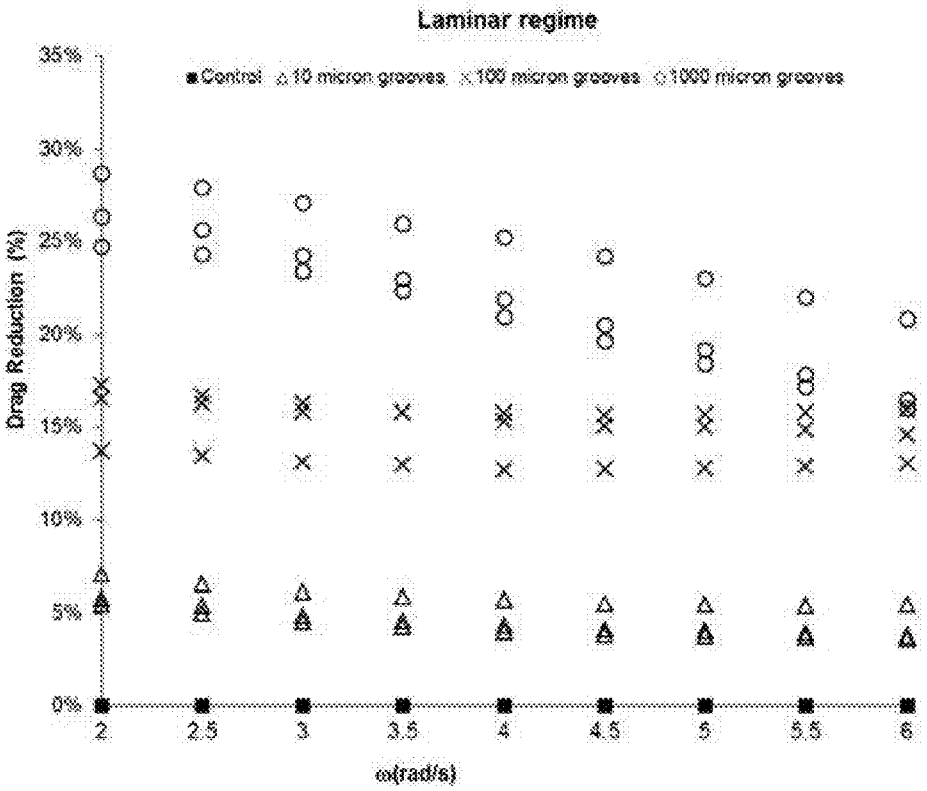
FIG. 6: is a plot of measured drag reduction (%) compared to the flat sample in laminar regime.

The drag reduction properties of the superhydrophobic samples are computed relative to the measurements with the control disk and shown in FIG. 6. The 1,000 μm grooved sample is the most efficient in reducing the drag. However, its drag reduction properties decrease as rotational speed increases whereas the 10 and 100 μm grooved samples have a more constant drag reduction (5% and 15% respectively). This is probably due to a more important deformation of the air-water interface with the large grooves compared to the smaller one.

Another way to estimate the slip length is to use Equation 4:

$$\delta \approx \frac{R_0\alpha}{4}\left(1-\sqrt{\frac{8\alpha T}{\pi\omega R_0^3\mu}-\frac{13}{3}}\right) \tag{4}$$

Figure 7:
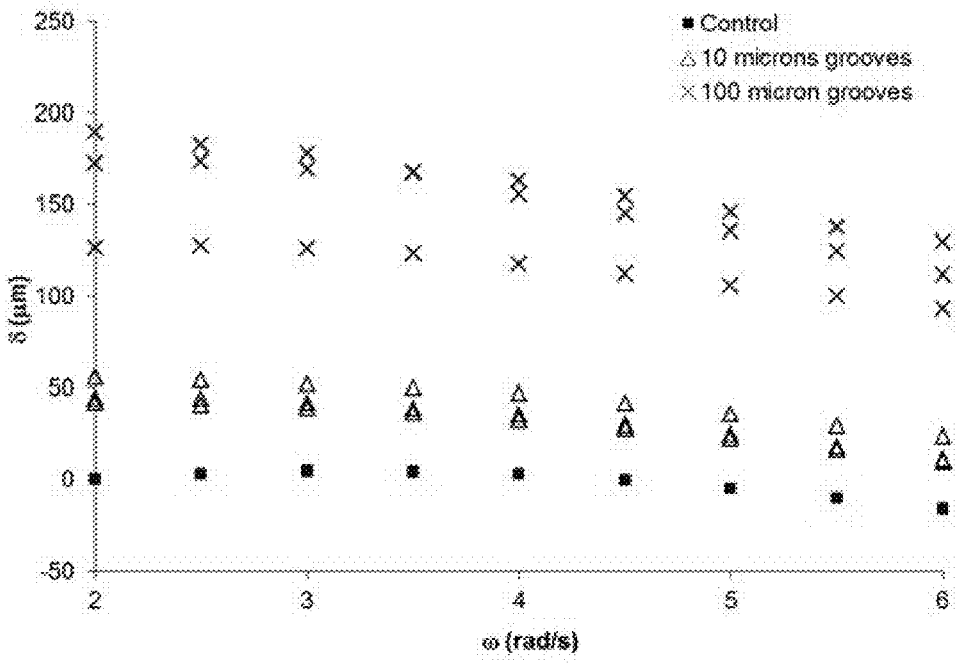
FIG. 7: is a plot showing slip lengths calculated with Equation (4) in the laminar regime for the control disk and the samples with 10 and 100 μm deep grooves.

Note that δ is not defined in Equation 4 if the torque is too low, which is the case for the 1,000 μm grooves sample. The slip length for the 10 μm and 100 μm grooved sample are approximately 50 μm and 150 μm, respectively (see FIG. 7). The secondary flow develops around ω≈4 rad/s, and causes the slip length to decrease from the expected zero value for the control disk. Above this angular speed, Equation 4 is no longer valid and CFD simulations are needed to estimate the slip length. The experimental results are compared to the numerical simulations performed with slip lengths varying from 0 (no slip) to 200 μm in FIG. 5. A good agreement is found between the simulations with a no slip boundary condition and the measurements with the control disk, which validates the numerical method used to simulate such flow. FIG. 5 shows that the slip length for the 100 μm grooves sample is found to be larger than 100 μm, and that the slip length for the 1,000 μm grooved sample is around 200 μm.

Although the slip length is legitimate for the 10 μm grooves sample since the groove depth is much smaller than the gap between the cone and the plate, it could be argued that the drag reduction is mainly caused by the grooves, which increase the gap between the cone and the plate, rather than the superhydrophobicity of the surface. However, each sample is initially loaded with the same amount of water and large pockets of air trapped in the grooves can be observed (see FIG. 4). The deviation in the torque measurements comes mainly from the small variation of the filling liquid when the excess water was removed (see the experimental approach section above).

Results in Turbulent Regime

Figure 8:
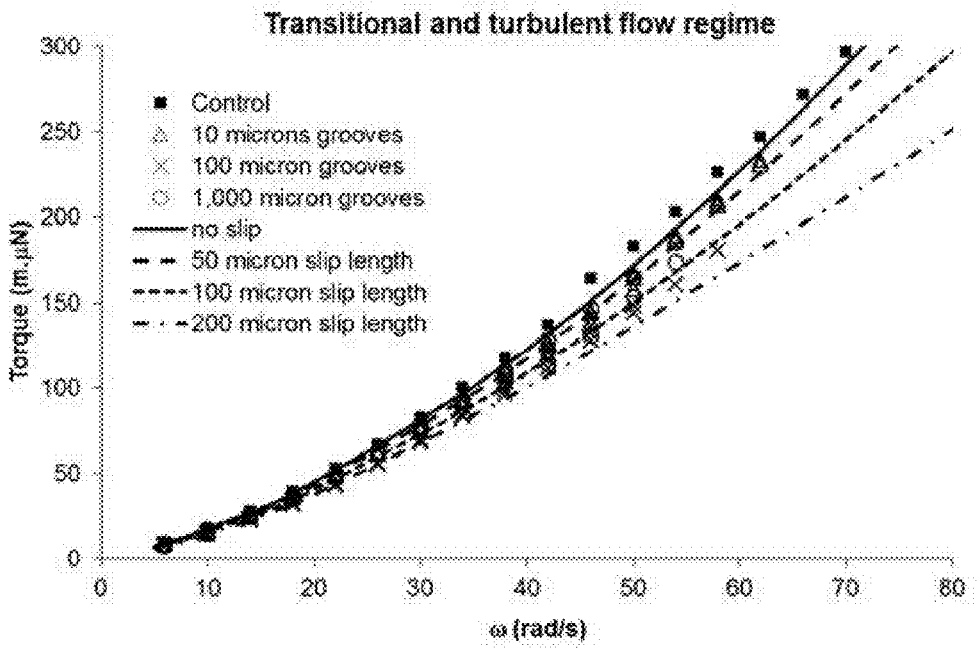
FIG. 8: is a plot showing torque measured on the cone in the transitional and turbulent regime for different samples (markers) and torque computed with the CFD simulations for different slip lengths.
Figure 9:
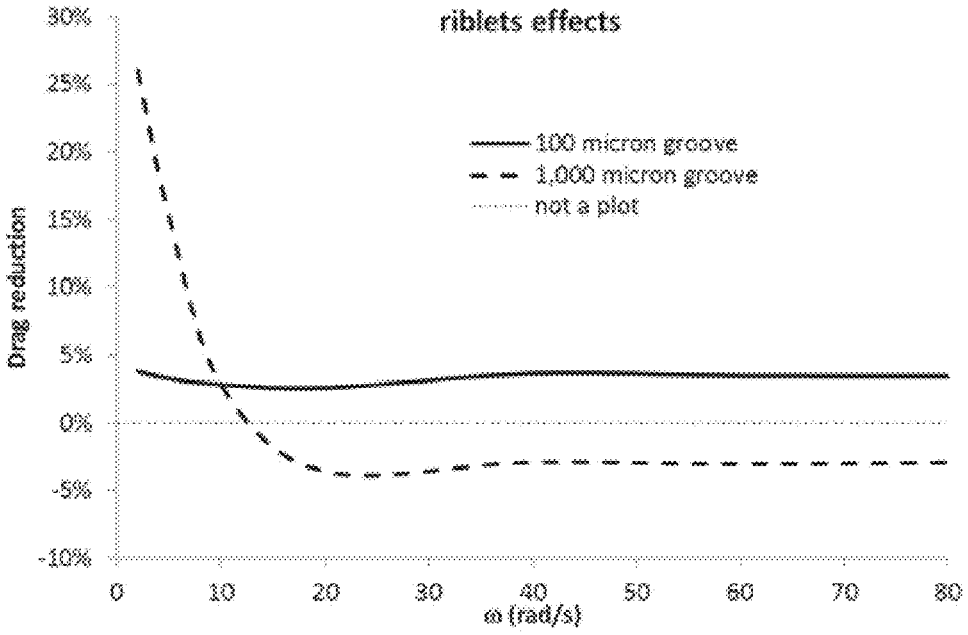
FIG. 9: is a plot showing calculated drag reduction (%) of the 100 and 1,000 μm groove samples compared to the flat geometry.
Figure 10:
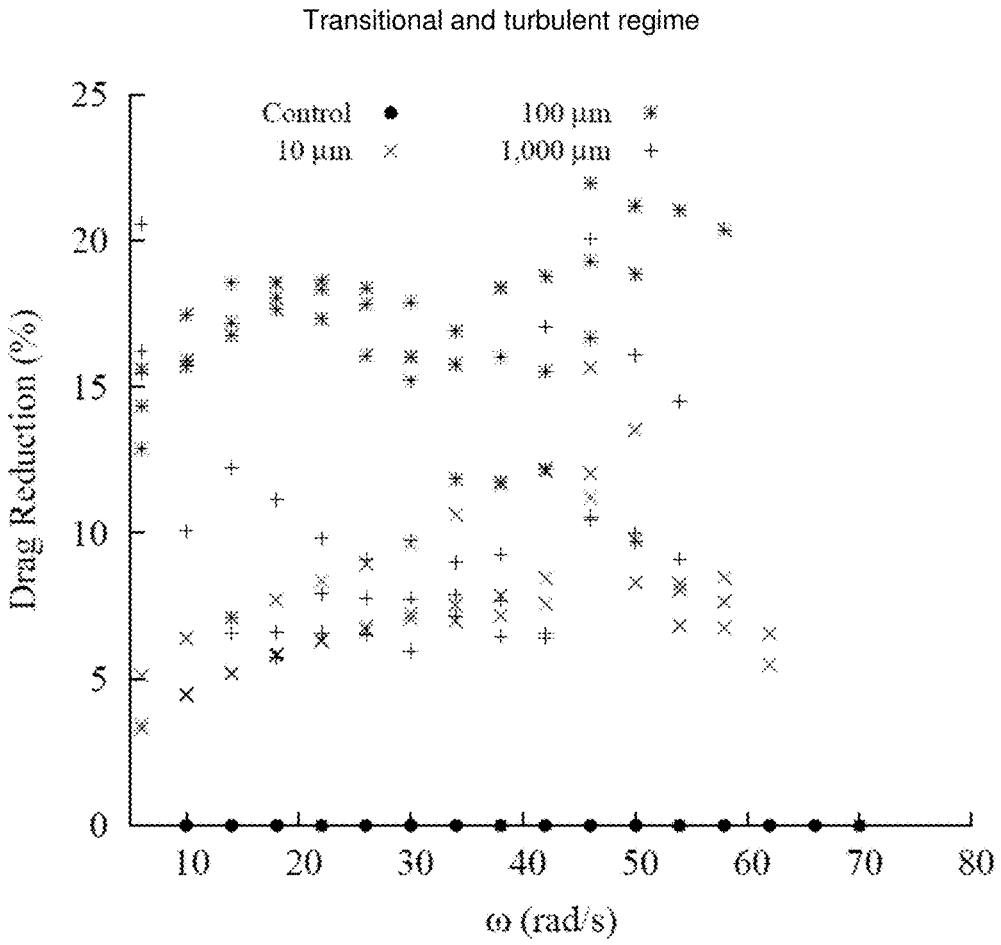
FIG. 10: is a plot of measured drag reduction (%) compared to the flat sample in transition and turbulent regime.

FIG. 8 shows the torque on the cone in the transitional and turbulent regime measured in the experiments and estimated by the simulations. Measurements up to 80 rad/s can be performed with the control sample, but for the superhydrophobic samples, the water is being squeezed out of the cone-and-plate space at much lower speed: ≈62 rad/s for the 10 μm grooved sample, ≈58 rad/s for the 100 μm grooved sample, and ≈54 rad/s for the 1,000 μm grooved sample. This is due to the slip boundary condition in the radial direction, which promotes the radial motion caused by the centrifugal forces. The 100 μm grooved sample is capable of reducing drag at high rotational speeds by 20% (see FIG. 10), whereas the 10 and 1,000 μm grooved sample are capable of reducing the drag by 5% to 10% only. The results show that overly large riblets induce a drag increase, whereas smaller riblets reduce drag by aligning the streamwise vortices above the surface. For the 100 μm grooved sample, the non-dimensional spacing $s^+=s/\delta\nu$ at 60 rad/s is approximately 8, which is small enough to cause drag reduction [15]. In order to estimate the riblets effect, simulations are performed with the 100 and 1,000 μm groove geometry with a no slip boundary condition on top and bottom (see FIG. 9). For low angular speed, a large drag reduction is observed for the 1,000 μm groove geometry, which is mainly caused by a larger distance between the cone and the bottom of the groove. However, as rotational speed increases, the 100 μm groove geometry maintains a 3.5% drag reduction, whereas a drag increase is observed with the 1,000 μm groove geometry.

Some discrepancies between the measurements for the control disk and the simulations are observed at large rotational speed, especially at the transition to turbulence (≈44 rad/s). As discussed previously, these differences come from the hypothesis made for the boundary conditions. Despite these uncertainties, FIG. 8 shows that the slip length of the 100 μm grooved sample ranges between 100 and 200 μm, which is a large slip length.

The data shown in FIGS. 5-8 and 10 is summarized in Tables 1-9.

TABLE 1

CONTROL SAMPLE - laminar regime

| Rotational speed (rad/s) | Torque (microN · m) | Slip Length (μm) | Drag Reduction (%) |
|---|---|---|---|
| 2 | 3.13 | 0.29 | 0 |
| 2.5 | 3.89 | 2.86 | 0 |
| 3 | 4.66 | 4.46 | 0 |
| 3.5 | 5.44 | 4.11 | 0 |
| 4 | 6.23 | 2.75 | 0 |
| 4.5 | 7.04 | −0.42 | 0 |
| 5 | 7.88 | −5.21 | 0 |
| 5.5 | 8.73 | −10.32 | 0 |
| 6 | 9.6 | −16.03 | 0 |

TABLE 2

| CONTROL SAMPLE - turbulent regime | | |
|---|---|---|
| Rotational speed (rad/s) | Torque (microN · m) | Drag Reduction (%) |
| 10 | 17.745 | 0 |
| 14 | 27.676 | 0 |
| 18 | 39.322 | 0 |
| 22 | 52.519 | 0 |
| 26 | 67.041 | 0 |
| 30 | 82.898 | 0 |
| 34 | 99.894 | 0 |
| 38 | 117.92 | 0 |
| 42 | 137.03 | 0 |
| 46 | 163.78 | 0 |
| 50 | 182.72 | 0 |
| 54 | 203.27 | 0 |
| 58 | 226.24 | 0 |
| 62 | 246.84 | 0 |
| 66 | 271.46 | 0 |
| 70 | 296.65 | 0 |

TABLE 3

| 10 MICRON SAMPLE - laminar regime | | | |
|---|---|---|---|
| Rotational speed (rad/s) | Torque (microN · m) | Slip Length (μm) | Drag Reduction (%) |
| 2 | 2.95 | 41.26 | 5.47 |
| 2.5 | 3.7 | 40.18 | 4.98 |
| 3 | 4.45 | 38.24 | 4.52 |
| 3.5 | 5.21 | 35.92 | 4.27 |
| 4 | 5.98 | 32.18 | 3.98 |
| 4.5 | 6.77 | 27.53 | 3.81 |
| 5 | 7.58 | 22.39 | 3.81 |
| 5.5 | 8.4 | 16.22 | 3.71 |
| 6 | 9.25 | 9.71 | 3.65 |
| 2 | 2.9 | 54.35 | 7.06 |
| 2.5 | 3.64 | 52.91 | 6.55 |
| 3 | 4.37 | 51.15 | 6.12 |
| 3.5 | 5.12 | 48.85 | 5.89 |
| 4 | 5.87 | 46.11 | 5.73 |
| 4.5 | 6.65 | 40.72 | 5.49 |
| 5 | 7.44 | 35.38 | 5.48 |
| 5.5 | 8.26 | 29.21 | 5.4 |
| 6 | 9.08 | 23.52 | 5.47 |
| 2 | 2.95 | 43.66 | 5.76 |
| 2.5 | 3.68 | 43.45 | 5.39 |
| 3 | 4.43 | 40.72 | 4.83 |
| 3.5 | 5.19 | 38.12 | 4.55 |
| 4 | 5.96 | 34.62 | 4.29 |
| 4.5 | 6.75 | 29.7 | 4.1 |
| 5 | 7.56 | 24.29 | 4.06 |
| 5.5 | 8.39 | 17.87 | 3.93 |
| 6 | 9.24 | 10.56 | 3.77 |

TABLE 4

| 10 MICRON SAMPLE - turbulent regime | | |
|---|---|---|
| Rotational speed (rad/s) | Torque (microN · m) | Drag Reduction (%) |
| A | | |
| 6 | 9.2513 | 3.29 |
| 10 | 16.957 | 4.44 |
| 14 | 26.24 | 5.19 |
| 18 | 37.033 | 5.82 |
| 22 | 49.211 | 6.30 |
| 26 | 62.562 | 6.68 |
| 30 | 76.91 | 7.22 |
| 34 | 92.357 | 7.54 |
| 38 | 108.67 | 7.84 |

TABLE 4-continued

| 10 MICRON SAMPLE - turbulent regime | | |
|---|---|---|
| Rotational speed (rad/s) | Torque (microN · m) | Drag Reduction (%) |
| 42 | 125.43 | 8.47 |
| 46 | 144.05 | 12.05 |
| 50 | 164.89 | 9.76 |
| 54 | 186.45 | 8.27 |
| 58 | 207.08 | 8.47 |
| 6 | 9.0741 | 5.15 |
| 10 | 16.608 | 6.41 |
| 14 | 25.706 | 7.12 |
| 18 | 36.288 | 7.72 |
| 22 | 48.136 | 8.35 |
| 26 | 61.044 | 8.95 |
| 30 | 74.902 | 9.65 |
| 34 | 89.275 | 10.63 |
| 38 | 104.19 | 11.64 |
| 42 | 120.43 | 12.11 |
| B | | |
| 46 | 138.14 | 15.66 |
| 50 | 158.02 | 13.52 |
| 54 | 186.92 | 8.04 |
| 58 | 208.9 | 7.66 |
| 62 | 230.66 | 6.55 |
| 6 | 9.2384 | 3.43 |
| 10 | 16.95 | 4.48 |
| 14 | 26.223 | 5.25 |
| 18 | 37.018 | 5.86 |
| 22 | 49.164 | 6.39 |
| 26 | 62.477 | 6.81 |
| 30 | 77.058 | 7.04 |
| 34 | 92.913 | 6.99 |
| 38 | 109.46 | 7.17 |
| 42 | 126.63 | 7.59 |
| 46 | 145.41 | 11.22 |
| 50 | 167.55 | 8.30 |
| 54 | 189.36 | 6.84 |
| 58 | 210.92 | 6.77 |
| 62 | 233.34 | 5.47 |

TABLE 5

| 100 MICRON SAMPLE - laminar regime | | | |
|---|---|---|---|
| Rotational speed (rad/s) | Torque (microN · m) | Slip Length (μm) | Drag Reduction (%) |
| 2 | 2.61 | 143.53 | 16.52 |
| 2.5 | 3.26 | 144.14 | 16.27 |
| 3 | 3.92 | 141.98 | 15.88 |
| 3.5 | 4.58 | 141.09 | 15.84 |
| 4 | 5.25 | 138.35 | 15.74 |
| 4.5 | 5.94 | 133.56 | 15.66 |
| 5 | 6.64 | 128.14 | 15.72 |
| 5.5 | 7.35 | 122.45 | 15.79 |
| 6 | 8.07 | 117.13 | 15.98 |
| 2 | 2.7 | 114.8 | 13.72 |
| 2.5 | 3.37 | 115.59 | 13.48 |
| 3 | 4.05 | 114.1 | 13.13 |
| 3.5 | 4.73 | 112.16 | 12.98 |
| 4 | 5.44 | 107.74 | 12.69 |
| 4.5 | 6.15 | 104.03 | 12.7 |
| 5 | 6.87 | 98.94 | 12.77 |
| 5.5 | 7.6 | 94 | 12.9 |
| 6 | 8.35 | 88.37 | 13.04 |
| 2 | 2.59 | 151.67 | 17.28 |
| 2.5 | 3.24 | 148.6 | 16.69 |
| 3 | 3.9 | 146.27 | 16.28 |
| 3.5 | 4.58 | 140.86 | 15.81 |
| 4 | 5.27 | 134 | 15.32 |
| 4.5 | 5.98 | 127.43 | 15.06 |
| 5 | 6.69 | 120.97 | 15.01 |

TABLE 5-continued

| 100 MICRON SAMPLE - laminar regime | | | |
|---|---|---|---|
| Rotational speed (rad/s) | Torque (microN · m) | Slip Length (μm) | Drag Reduction (%) |
| 5.5 | 7.43 | 113.02 | 14.86 |
| 6 | 8.2 | 103.23 | 14.59 |

TABLE 6

| 100 MICRON SAMPLE - turbulent regime | | |
|---|---|---|
| Rotational speed (rad/s) | Torque (microN · m) | Drag Reduction (%) |
| 6 | 8.0718 | 15.62 |
| 10 | 14.644 | 17.48 |
| 14 | 22.536 | 18.57 |
| 18 | 32.023 | 18.56 |
| 22 | 42.728 | 18.64 |
| 26 | 55.085 | 17.83 |
| 30 | 69.606 | 16.03 |
| 34 | 84.132 | 15.78 |
| 38 | 99.008 | 16.04 |
| 42 | 115.74 | 15.54 |
| 46 | 132.19 | 19.29 |
| 50 | 148.26 | 18.86 |
| 6 | 8.3342 | 12.88 |
| 10 | 14.957 | 15.71 |
| 14 | 22.916 | 17.20 |
| 18 | 32.228 | 18.04 |
| 22 | 43.42 | 17.33 |
| 26 | 56.262 | 16.08 |
| 30 | 70.268 | 15.24 |
| 34 | 88.07 | 11.84 |
| 38 | 104.08 | 11.74 |
| 42 | 120.33 | 12.19 |
| 46 | 136.47 | 16.67 |
| 6 | 8.1966 | 14.32 |
| 10 | 14.921 | 15.91 |
| 14 | 23.034 | 16.77 |
| 18 | 32.375 | 17.67 |
| 22 | 42.884 | 18.35 |
| 26 | 54.715 | 18.39 |
| 30 | 68.069 | 17.89 |
| 34 | 82.992 | 16.92 |
| 38 | 96.228 | 18.40 |
| 42 | 111.29 | 18.78 |
| 46 | 127.84 | 21.94 |
| 50 | 144.01 | 21.19 |
| 54 | 160.49 | 21.05 |
| 58 | 180.19 | 20.35 |

TABLE 7

| 1 MM SAMPLE - laminar regime | | | |
|---|---|---|---|
| Rotational speed (rad/s) | Torque (microN · m) | Slip Length (μm) | Drag Reduction (%) |
| 2 | 2.3 | 262.5 | 26.31 |
| 2.5 | 2.9 | 256.68 | 25.62 |
| 3 | 3.53 | 240.5 | 24.24 |
| 3.5 | 4.19 | 223.77 | 22.99 |
| 4 | 4.87 | 208.14 | 21.89 |
| 4.5 | 5.6 | 187.19 | 20.51 |
| 5 | 6.37 | 165.38 | 19.17 |
| 5.5 | 7.17 | 143.92 | 17.83 |
| 6 | 8.02 | 122.58 | 16.51 |
| 2 | 2.35 | 240.67 | 24.7 |
| 2.5 | 2.95 | 238.77 | 24.28 |
| 3 | 3.57 | 229.52 | 23.4 |
| 3.5 | 4.22 | 215.48 | 22.33 |
| 4 | 4.92 | 196.63 | 20.94 |
| 4.5 | 5.66 | 176.76 | 19.61 |

TABLE 7-continued

| 1 MM SAMPLE - laminar regime | | | |
|---|---|---|---|
| Rotational speed (rad/s) | Torque (microN · m) | Slip Length (μm) | Drag Reduction (%) |
| 5 | 6.42 | 157.19 | 18.44 |
| 5.5 | 7.23 | 136.73 | 17.16 |
| 6 | 8.07 | 117.32 | 16 |
| 2 | 2.23 | 296.61 | 28.69 |
| 2.5 | 2.81 | 288.97 | 27.91 |
| 3 | 3.4 | 278.77 | 27.04 |
| 3.5 | 4.03 | 263.18 | 25.96 |
| 4 | 4.66 | 251.33 | 25.24 |
| 4.5 | 5.34 | 232.71 | 24.18 |
| 5 | 6.06 | 211.3 | 23.03 |
| 5.5 | 6.81 | 191.42 | 21.99 |
| 6 | 7.6 | 169.75 | 20.83 |

TABLE 8

| 1 MM SAMPLE - turbulent regime | | |
|---|---|---|
| Rotational speed (rad/s) | Torque (microN · m) | Drag Reduction (%) |
| 6 | 8.0155 | 16.21 |
| 10 | 15.956 | 10.08 |
| 14 | 25.859 | 6.57 |
| 18 | 37.066 | 5.74 |
| 22 | 48.352 | 7.93 |
| 26 | 61.825 | 7.78 |
| 30 | 76.478 | 7.74 |
| 34 | 92.004 | 7.90 |
| 38 | 108.84 | 7.70 |
| 42 | 128.02 | 6.58 |
| 46 | 146.64 | 10.47 |
| 50 | 165 | 9.70 |
| 54 | 184.77 | 9.10 |
| 6 | 8.0835 | 15.50 |
| 10 | 15.958 | 10.07 |
| 14 | 25.703 | 7.13 |
| 18 | 36.722 | 6.61 |
| 22 | 49.061 | 6.58 |
| 26 | 62.644 | 6.56 |
| 30 | 77.947 | 5.97 |
| 34 | 92.731 | 7.17 |
| 38 | 110.29 | 6.47 |
| 42 | 128.22 | 6.43 |
| 46 | 146.5 | 10.55 |
| 50 | 164.46 | 9.99 |
| 6 | 7.5989 | 20.57 |
| 10 | 14.956 | 15.72 |
| 14 | 24.29 | 12.23 |
| 18 | 34.944 | 11.13 |
| 22 | 47.356 | 9.83 |
| 26 | 60.939 | 9.10 |
| 30 | 74.809 | 9.76 |
| 34 | 90.906 | 9.00 |
| 38 | 106.99 | 9.27 |
| 42 | 113.64 | 17.07 |
| 46 | 130.92 | 20.06 |
| 50 | 153.31 | 16.10 |
| 54 | 173.83 | 14.48 |

TABLE 9

| Torque (microN · m) estimated with simulations | | | |
|---|---|---|---|
| Rotational speed | Slip Length | | |
| (rad/s) | 0 μm | 100 μm | 200 μm |
| 2 | 3.12 | 2.76 | 2.47 |
| 5 | 7.82 | 6.96 | 6.3 |
| 6 | 9.58 | 8.53 | 7.72 |

TABLE 9-continued

| Torque (microN · m) estimated with simulations | | | |
|---|---|---|---|
| Rotational speed | Slip Length | | |
| (rad/s) | 0 μm | 100 μm | 200 μm |
| 10 | 17.75 | 16.24 | 14.72 |
| 20 | 45.92 | 42.44 | 37.74 |
| 40 | 128.69 | 114.27 | 97.09 |
| 60 | 237.53 | 206.29 | 168.95 |
| 80 | 373.58 | 309.18 | 246.91 |

An innovative surface was designed to efficiently and passively reduce drag over a large range of flow regimes. The combination of riblets and superhydrophobicity is capable of reducing drag up to 20% in the turbulent regime. The experiments show that if the riblets are too small or too large, the drag reduction property is reduced but still present (at least 5%).

Satisfying results are observed with the 100 μm deep grooved sample. According to the simulations, the slip length of this geometry remained above 100 μm in the turbulent regime. As an example application, a 300 m oil tanker cruising at 16 knots would have its drag reduced by at least 44% by such material. However, the slip length of the tested samples are measured under a shear rate up to 1,700 $s^{-1}$, which is still one order of magnitude lower than in a tanker flow ($=\approx 5\times10^4 s^{-1}$).

Although the present invention has been described in considerable detail with reference to certain preferred versions thereof, other versions are possible. Therefore, the spirit and scope of the appended claims should not be limited to the description of the preferred versions contained herein.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C § 112, sixth paragraph. In particular, the use of "step of" in the claims herein is not intended to invoke the provisions of 35 U.S.C § 112, sixth paragraph.

What is claimed is:

1. An article comprising:

a surface comprising a plurality of grooves, the grooves having a depth of 10 μm to 1000 μm;

a series of nano-sharp pore ridges having a width of ≤5 nm, the ridges defined by a series of overlapping pores comprising hexagonal pore openings, the nano-sharp pore ridges and pores arranged coextensively with the plurality of grooves along the surface, wherein the pores have a flared geometry over their entire length the flared geometry comprises a decreasing diameter along an axis perpendicular to the surface, wherein the pores are spaced at an average center-to-center distance of 1 nm to 980 nm from each other and the pores have an opening ≤1000 nm, and wherein the pores and nano-sharp pore ridges are formed by a process including alternatingly-repeated steps of anodization and etching of said surface; and a sub-μm thick layer of a hydrophobic polymer on said surface.

2. The article according to claim 1, wherein the surface comprises one selected from the group consisting of aluminum, titanium, zinc, magnesium, niobium, zirconium, hafnium, tantalum, and combinations thereof.

3. The article according to claim 1, wherein the plurality of nano-sharp ridges each have a length and a height of from 1 to 500 nm.

4. The article according to claim 1, wherein the hydrophobic polymer is a fluorinated polymer.

5. The article according to claim 1, wherein the hydrophobic polymer is selected from the group consisting of a polytetrafluoroethylene, an eethylenic-cyclo oxyaliphatic substituted ethylenic copolymer, a perfluoroalkoxy, and combinations thereof.

6. The article according to claim 1, wherein the plurality of pores each have a first diameter of from 5 to 750 nm at an outermost point of the surface and a second diameter of from 1 to 500 nm at a depth of from 50 to 1000 nm beneath the outermost point surface.

7. A product comprising the article according to claim 1, wherein the product is selected from the group consisting of a marine vehicle, a mirror, a torpedo, a water pipe, a component of a tidal energy system, and combinations thereof.

8. The article of claim 1, wherein the average center-to-center distance is 1-100 nm.

9. The article of claim 1, wherein the average center-to-center distance is 130-980 nm.

* * * * *